US007112395B2

(12) United States Patent
Ida et al.

(10) Patent No.: US 7,112,395 B2
(45) **Date of Patent: *Sep. 26, 2006**

(54) COLOR TONER

(75) Inventors: Tetsuya Ida, Shizuoka (JP); Yasuhiro Ichikawa, Kanagawa (JP); Hirohide Tanikawa, Shizuoka (JP); Nozomu Komatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

This patent is subject to a terminal disclaimer.

(21) Appl. No.: 10/792,712

(22) Filed: Mar. 5, 2004

(65) Prior Publication Data

US 2004/0175642 A1 Sep. 9, 2004

(30) Foreign Application Priority Data

Mar. 7, 2003 (JP) ..... 2003-061826

(51) Int. Cl.
*G03G 9/087* (2006.01)

(52) U.S. Cl. ..... 430/109.4; 430/111.4; 430/110.3; 430/110.4; 430/108.8

(58) Field of Classification Search ..... 430/111.4, 430/110.3, 110.4, 109.4, 108.8
See application file for complete search history.

(56) References Cited

U.S. PATENT DOCUMENTS

| | | | | |
|---|---|---|---|---|
| 5,171,654 | A | 12/1992 | Yamazaki et al. | 430/110 |
| 5,364,722 | A | 11/1994 | Tanikawa et al. | 430/110 |
| 5,384,224 | A | 1/1995 | Tanikawa et al. | 430/106 |
| 6,120,961 | A | 9/2000 | Tanikawa et al. | 430/110 |
| 6,203,959 | B1 | 3/2001 | Tanikawa et al. | 430/110 |
| 6,436,599 | B1 | 8/2002 | Matsuoka et al. | 430/137.19 |
| 6,613,490 | B1 * | 9/2003 | Matsunaga et al. | 430/111.4 |
| 2003/0039908 | A1 * | 2/2003 | Hiratsuka et al. | 430/110.3 |
| 2004/0175643 | A1 * | 9/2004 | Baba et al. | 430/109.4 |

(Continued)

FOREIGN PATENT DOCUMENTS

EP 1249735 10/2002

(Continued)

OTHER PUBLICATIONS

Diamond, Arthur S & David Weiss (eds.) Handbook of Imaging Materials. New York: Marcel-Dekker, Inc. (Nov. 2001) pp. 155-159.*

*Primary Examiner*—Christopher RoDee
(74) *Attorney, Agent, or Firm*—Fitzpatrick, Cella, Harper & Scinto

(57) ABSTRACT

To provide a color toner which is effective in mitigating contamination of a charging member, which is good at low temperature fixing in high-speed copying, and which is excellent in blocking resistance and electrification stability in continuous copying. Provided is a color toner containing at least a binder resin, a colorant, and a releasing agent, in which: (i) the binder resin contains at least a polyester unit; (ii) a weight average particle diameter of the color toner is greater than 6.5 μm and equal to or less than 11 μm; (iii) an average circularity A of particles in the color toner each having a circle-equivalent diameter of 3 μm or more satisfies the relationship of $0.915 \leqq A \leqq 0.960$; (iv) a permeability B (%) of the color toner in a 45 vol % aqueous solution of methanol satisfies the relationship of $10 \leqq B \leqq 70$; and (v) an endothermic curve obtained through differential thermal analysis (DSC) measurement of the color toner has one or multiple endothermic peaks in the temperature range of 30 to 200° C., and a temperature Tsc of the highest endothermic peak of the one or multiple endothermic peaks satisfies the relationship of 65° C.<Tsc<105° C.

13 Claims, 4 Drawing Sheets

U.S. PATENT DOCUMENTS

2005/0079429 A1* 4/2005 Hayami et al. ..... 430/109.4

FOREIGN PATENT DOCUMENTS

JP 7-181732 7/1995
JP 11-44969 2/1999
JP 00-29241 1/2000

* cited by examiner

COLOR TONER

FIELD OF THE INVENTION

The present invention relates to a color toner used for image forming methods such as an electrophotographic method, an electrostatic recording method, an electrostatic printing method, and a toner jet method. In particular, the present invention relates to a color toner suitable for oilless fixing.

DESCRIPTION OF THE RELATED ART

Owing to demands for space and energy savings etc, rigorous efforts have been made to achieve miniaturization, weight reduction, higher speed, and higher reliability of copying machines and printers in recent years. Accordingly, those machines are increasingly constructed from components that are simplified in many aspects. As a result, increasingly higher performance is required of toner. Therefore, superior machines cannot be established without performance improvement of toner.

For example, various methods and apparatuses have been developed for a step of fixing a toner image to a sheet such as paper. Conventionally, to prevent the toner from adhering onto the surface of a fixing member, the toner has been formed from a material excellent in releasability, and to avoid offset on a roller surface and fatigue of the roller surface, the roller surface has been coated with a thin film made from a liquid with good releasability such as silicone oil.

The above conventional method is highly effective for the prevention of the toner offset, however the method requires an apparatus for supplying a liquid for offset prevention and thus involves a problem in that a fixing apparatus adopts a complicated structure etc. This tends against the miniaturization and weight reduction. Moreover, silicone oil or the like may evaporate by virtue of heat to cause contamination of the inside of a machine. In view of the above, an attempt has been made to supply the liquid for offset prevention from inside toner during heating without using a silicone oil supplying apparatus. From this attempt, a method of adding a releasing agent such as low molecular weight polyethylene or low molecular weight polypropylene to the toner has been proposed.

Addition of a releasing agent to toner shows a remarkable effect in such a fixing configuration that very low pressure is applied upon fixing and the releasing agent is precipitated on the toner surface by fusing the releasing agent before fixation. However, if the releasing agent is not precipitated near the toner surface, the releasability of toner with the fixing member cannot be sufficiently exhibited and thus the fixability of toner becomes poor. Furthermore, particularly in today's colorizing, several colors are mixed to represent a color. Therefore, a large amount of toner is unavoidably fixed at once, so that how appropriately use a releasing agent having a low melting point effective for fixing becomes a concern.

Furthermore, for toner containing a releasing agent produced by a pulverization method, the releasing agent precipitated near the toner surface much differs from a resin or the like in its charging performance. Therefore, it has been difficult to achieve uniform charging no matter how high the chargeability of a material to be incorporated into the resin is. In addition, if the releasing agent is unbalancedly precipitated near the toner surface in a large amount, during printing of multiple sheets for a long period of time, the releasing agent may contaminate a charge imparting member such as a developing sleeve or a carrier on which the toner strongly rubs, so that developability may deteriorate. As described above, the amount of the releasing agent (hereinafter, referred to as "releasing-agent amount") near the toner surface affects the overall electrophotographic properties. Therefore, it is important to achieve the balanced presence of the releasing agent near the toner surface.

In addition, in an apparatus using an intermediate transfer body, a toner shape significantly affects transfer. In particular, transfer residual toner caused by repeating transfer multiple times has a profound effect. With increasing amount of the transfer residual toner, a load on a main body such as a toner collection system increases, and also the amount of the toner to be used per sheet increases. As a result, a running cost increases. In view of the above, a method in which toner is formed into as spherical a shape as possible to improve transfer efficiency thereof is effective.

In the meantime, there has been a growing need for broadening the range of a transfer material for full color to cover various materials including cardboard and small-size paper such as a card and a postcard in addition to normal paper and a film for an overhead projector (OHP). Accordingly, a transfer method using an intermediate transfer body has become effective. In a system using an intermediate transfer body, it is usually necessary to transfer a developed image of toner from a photosensitive body to the intermediate transfer body and then to transfer the image from the intermediate transfer body to a transfer material. Therefore, a further improvement in the transfer efficiency of the toner as compared to the conventional method is needed. In particular, when using a full-color copying machine in which multiple toner images are developed and then transferred, the toner amount on a photosensitive body increases as compared to the case of a monochrome black toner to be used in a monochrome copying machine. Therefore, merely using the conventional toner makes it difficult to improve the transfer efficiency.

In view of the above, making a toner shape as spherical as possible has been performed in recent years as an approach for improving the transfer efficiency. For example, a method in which a polymerized toner produced via suspension polymerization, emulsion polymerization, or the like or a pulverized toner is sphered in a solvent (see, for instance, JP 11-044969 A), a method in which toner is sphered with hot air (see, for instance, JP 2000-029241 A), and a method in which toner is sphered with mechanical impact force (see, for instance, JP 07-181732 A) are known. Those techniques are highly effective in improving the transfer efficiency.

However, a releasing agent is unavoidably included in a polymerized toner. Therefore, in the case where high pressure cannot be applied upon fixing (for example, in the case of SURF fixing), the releasing agent hardly appears at the toner surface, thereby resulting in deteriorated fixability. In addition, in the case of a sphered pulverized toner, a releasing agent is easily eluted on the toner surface by a solvent or heat and thus the existing amount of the releasing agent (hereinafter, referred to as "releasing-agent existing amount") increases more than necessary. Apparatuses for applying mechanical impact force typified by Hybridization System manufactured by Nara Machinery Co., Ltd., Mechanofusion System manufactured by Hosokawa Micron Corp., Criptron System manufactured by Kawasaki Heavy Industries, Ltd., Super Rotor manufactured by Nisshin Engineering Inc. and the like have been generally used in the conventional toner production system. At first glance, each of the above apparatuses does not require a significant quantity of heat. However, the above apparatuses actually apply substantial quantities of heat to particles to be treated in obtaining nearly spherical particles. Therefore, in fact, the above apparatuses adversely affect the electrophotographic properties of toner particles to be obtained. Moreover, each of the above apparatuses involves the following problem. That is, fine powders produced during pulverization process adhere to or are embedded into the toner surface to have a harmful effect on the progress of sphering, so that a nearly spherical particle cannot be obtained unless otherwise treatment with a greater quantity of heat is performed. Unless those fine powders are treated, those fine powders are inevitably mixed as toner into a product as they are because of the difficulty in classifying those fine powders. Those fine powders also adversely affect the electrophotographic properties.

In view of the above, a further improvement in toner containing a releasing agent, in particular, toner containing a releasing agent having a low melting point, produced by the pulverization method has been demanded because the toner significantly affects the electrophotographic properties.

SUMMARY OF THE INVENTION

The present invention has been proposed to solve the above problems.

An object of the present invention is to provide a color toner that is advantageous with respect to contamination of a developing sleeve and has a sufficient fixable range.

Another object of the present invention is to provide a color toner that provides sufficient developability even in continuous use.

Still another object of the present invention is to provide a color toner which has high transfer efficiency, in which scattering is suppressed, which enables good cleaning more easily, and which facilitates the formation of a beautiful and pictorial full-color image.

Therefore, the present invention relates to a color toner containing at least a binder resin, a colorant, and a releasing agent, in which:

(i) the binder resin contains at least a polyester unit;

(ii) a weight average particle diameter of the color toner is greater than 6.5 μm and equal to or less than 11 μm;

(iii) an average circularity A of particles in the color toner each having a circle-equivalent diameter of 3 μm or more satisfies the relationship of $0.915 \leqq A \leqq 0.960$;

(iv) a permeability B (%) of the color toner in a 45 vol % aqueous solution of methanol satisfies the relationship of $10 \leqq B \leqq 70$; and (v) an endothermic curve obtained through differential thermal analysis (DSC) measurement of the color toner has one or multiple endothermic peaks in the temperature range of 30 to 200° C., and a temperature Tsc of the highest endothermic peak of the one or multiple endothermic peaks satisfies the relationship of 65° C.<Tsc<105° C.

DETAILED DESCRIPTION OF THE INVENTION

Figure 1:
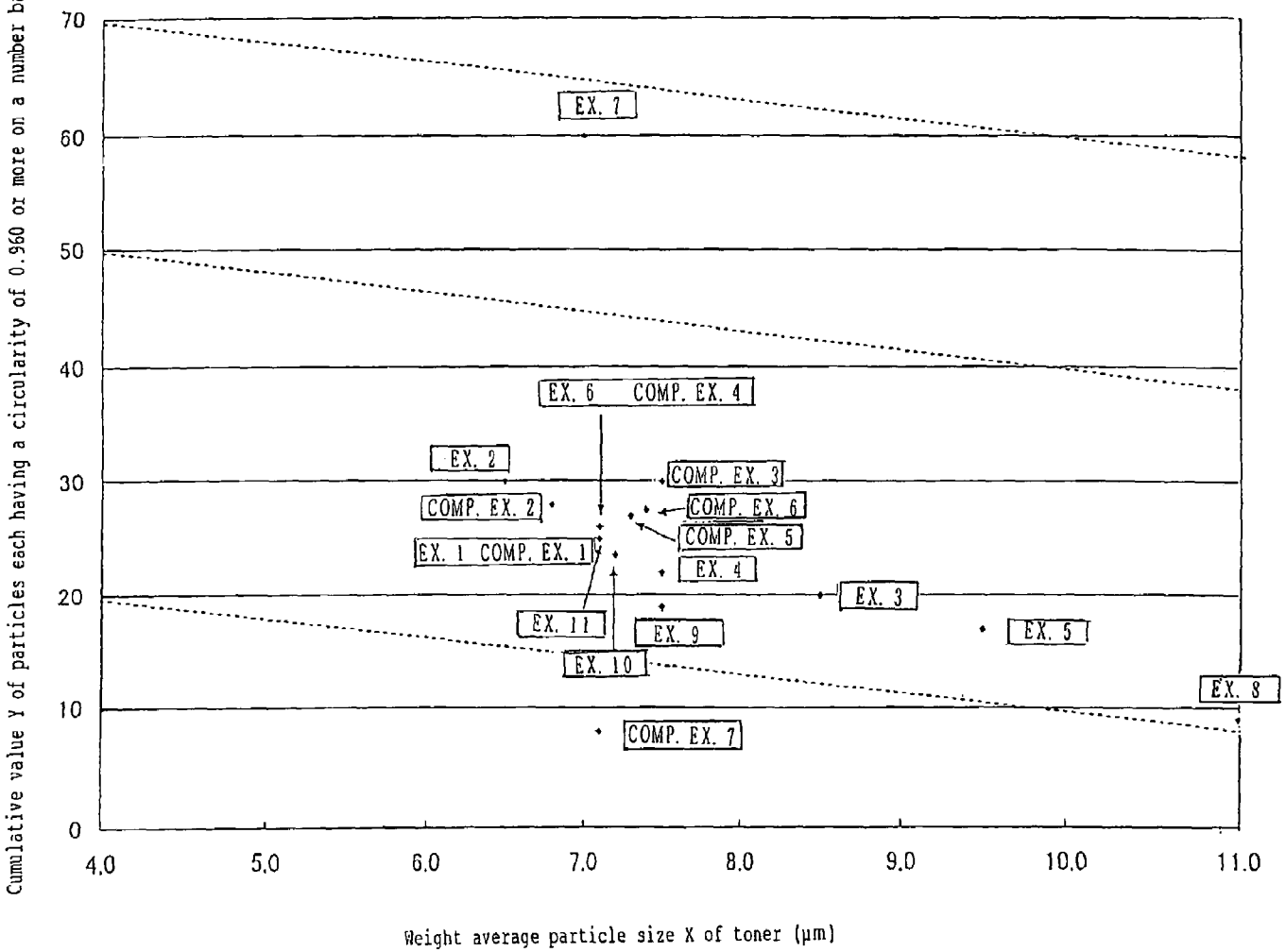
FIG. 1 is a diagram showing a relationship between a weight average particle diameter X and a cumulative value Y of particles each having a circularity of 0.960 or more on a number basis.

The inventors of the present invention have made extensive studies to find out that balancing the shape of a color toner and existing amounts of various materials on the color toner surface provides a color toner that can solve the above problems, thereby achieving the present invention.

In the present invention, a desired shape of a color toner is as follows. That is, an average circularity A of particles in the color toner each having a circle-equivalent diameter of 3 μm or more satisfies the relationship of $0.915 \leqq A \leqq 0.960$, preferably satisfies the relationship of $0.920 \leqq A \leqq 0.945$, more preferably satisfies the relationship of $0.923 \leqq A \leqq 0.943$. If A is less than 0.915, transferability, in particular, transfer efficiency is poor. Conversely, if A is greater than 0.960, in cleaning a photosensitive drum, the color toner slips through a cleaning blade, so that image failure resulting from cleaning failure is liable to occur.

Furthermore, in the present invention, the releasing-agent amount on the color toner surface is controlled.

The releasing-agent amount near the color toner surface can be grasped with ease and high accuracy with regard to the whole color toner particles by measuring a permeability in a 45 vol % aqueous solution of methanol. In this measurement method, the color toner is once forcedly dispersed in a solvent mixture, the effect of the releasing-agent existing amount on the surface of each color toner particle is made to be easily exhibited, and then a permeability after a predetermined period of time is measured. As a result, the releasing-agent existing amount on the whole color toner surface can be accurately grasped. In other words, if a hydrophobic releasing agent is present on the toner surface in a large amount, the toner is hardly dispersed and aggregates, so that the permeability has a high value. Conversely, if no releasing agent is present on the toner surface, a hydrophilic polyester unit in a binder resin occupies most of the toner surface, so that the toner is uniformly dispersed and the permeability has a low value.

In the present invention, a desired permeability is as follows. A permeability B (%) in a 45 vol % aqueous solution of methanol satisfies the relationship of $10 \leqq B \leqq 70$, preferably satisfies the relationship of $15 \leqq B \leqq 50$. If B is less than 10, the releasing agent is present on the toner surface in a small amount, and a releasing effect is hardly exhibited upon fixing. As a result, it becomes difficult to perform low temperature fixing which is desired from the viewpoint of energy saving, and a fixing configuration needs to be provided with a load requiring considerable pressure. Conversely, if B is greater than 70, the releasing agent is present on the toner surface in a large amount to contaminate a member with which the toner contacts. For example, the releasing agent is fused onto a developing sleeve to provide a high resistance. As a result, the efficiency of an actual developing bias necessary for development deteriorates and thus an image density may decrease.

Comparisons are made with the physical properties of the conventional color toner. In a color toner or a polymerized toner that uses no releasing agent, no hydrophobic releasing agent is present on the toner surface, so that the permeability is low, that is, the permeability B is less than 10. If a releasing agent is used in a small amount or if used is a releasing agent with which the melting point of the toner or a temperature of the highest endothermic peak of the toner is 105° C. or more, the permeability is also low, that is, the permeability B is also less than 10%. Such a permeability is insufficient in terms of fixability.

Furthermore, the present invention defines another performance of the color toner as described above. Specifically, the present invention defines a temperature of an endothermic peak of the color toner.

In the present invention, a desired temperature of an endothermic peak is as follows. An endothermic curve obtained through differential thermal analysis (DSC) measurement of the color toner of the present invention has one or multiple endothermic peaks in the temperature range of 30 to 200° C. In addition, a peak temperature Tsc of the highest endothermic peak of the one or multiple endothermic peaks satisfies the relationship of 65° C.<Tsc<105° C., preferably satisfies the relationship of 70° C.<Tsc<90° C. If Tsc is 65° C. or less, a blocking property is poor. If Tsc is 105° C. or more, it becomes difficult to perform low temperature fixing which is desired from the viewpoint of energy saving, and a fixing configuration requires considerable pressure.

The main factor in determining a value for the peak temperature Tsc of the highest endothermic peak of the color toner is a releasing agent. Therefore, the value for the peak temperature Tsc of the highest endothermic peak can be appropriately adjusted in consideration of the kind of releasing agent or the like.

The inventors of the present invention have confirmed that, in order to obtain a color toner having the desired shape and performance as described above in the present invention, it is effective to provide, in the process of producing a color toner, a step of applying mechanical impact force while discharging fine powders produced to the outside of a system (this step is described in detail later). In other words, in a pulverizing step and a sphering step, fine powders produced should be discharged to the outside of the system irrespective of whether each of the pulverizing step and the sphering step is performed separately or both the steps are performed simultaneously. This is because considerably small fine powders produced during pulverization and sphering aggregate to produce irregularities on the particle shape, so that mechanical impact force that is greater than required is necessary to achieve a desired sphericity. In this case, an excessive quantity of heat is applied to increase the releasing-agent amount on the toner surface. The increase in releasing-agent amount has a harmful effect. Furthermore, a small fine powder is a major factor in deteriorating spent to a carrier to be used in a two-component developer. If particles pulverized by mechanical impact force are carried by an air stream as they are to be introduced into a classifying portion for classification without checking the air stream, the fine powders are efficiently discharged to the outside of the system without being reaggregated. The above statement shows that the toner shape, the fine powder amount, and the releasing-agent existing amount can be controlled as desired if mechanical impact force is applied while fine powders produced are discharged to the outside of the system. Therefore, the color toner of the present invention which is obtained not only by sphering but also by consideration of a balance between the sphericity and the existing amount of the releasing agent or the like on the color toner surface and which satisfies the above requirements can solve the above-described problems involved in the conventional color toner.

It should be noted that the average circularity A and the permeability B defined in the present invention are as follows in the case where a color toner is produced according to a method showing below.

In a color toner using a releasing agent, in the case where the color toner is produced according to an air jet system, a desired permeability B can be obtained, that is, B satisfies the relationship of $10 \leqq B \leqq 70$, but the average circularity A does not have a desired value, that is, A is less than 0.915.

In the case where a color toner is produced by using a sphering means such as Hybridization System manufactured by Nara Machinery Co., Ltd., considerably small fine particles produced during pulverization cannot be removed. Therefore, for instance, the number of revolutions of the system is increased more than necessary, or residence time is prolonged. As a result, an excessively great quantity of heat is applied to increase the existing amount of wax on the toner surface, and thus the permeability B exceeds 70.

In addition, in the case where a color toner is produced by using Criptron System manufactured by Kawasaki Heavy Industries, Ltd., Super Rotor manufactured by Nisshin Engineering Inc, or the like in which pulverization and sphering are simultaneously performed, considerably small fine particles produced during pulverization cannot be removed as with the above case. As a result, an excessively great quantity of heat is applied, and thus the permeability B exceeds 70.

In addition, in the case where a color toner is produced by using Therfusing System manufactured by Nippon Pneumatic Mfg. Co., Ltd. in which heat is applied to perform sphering, a substantial quantity of heat is applied as a matter of course. Therefore, the permeability B exceeds 70.

Furthermore, in the color toner of the present invention, if a requirement defining the relationship between a toner particle diameter and a ratio of toner having a high sphericity is satisfied in addition to the above requirements, a more preferable color toner can be obtained.

A weight average particle diameter of the color toner of the present invention is greater than 6.5 μm and equal to or less than 11 μm. A weight average particle diameter of equal to or less than 6.5 μm tends to cause toner aggregation and fogging. A weight average particle diameter in excess of 11 μm makes it difficult to obtain a high-definition image. In addition, a weight average particle diameter of the color toner of the present invention is preferably in the range of 6.7 to 9.5 μm.

In the color toner of the present invention, controlling the relationship between a color toner particle diameter and a ratio of color toner having a high sphericity can further enhance the effect of the present invention. Specifically, as shown in FIG. 1, a weight average particle diameter X (μm) of the color toner and a cumulative value Y (%) of particles each having a circularity of 0.960 or more on a number basis preferably satisfy the relationship of $-X+20 \leqq Y \leqq -X+70$. X and Y more preferably satisfy the relationship of $-X+20 \leqq Y \leqq -X+50$. The relationship of $-X+20 \leqq Y \leqq -X+70$ defines a color toner diameter and a ratio of color toner having a high sphericity in the color toner, and shows a suitable range for establishing compatibility between developability and transferability. In order to enhance developability, it is important to mitigate contamination of the developing sleeve. To achieve this, a packing property of the toner is preferably low and it is recommended that the color toner particle diameter be large or the sphericity of the color toner be low. On the other hand, in order to improve transferability, for example, in order to improve transfer efficiency or to suppress scattering, the sphericity of the color toner is preferably high. In addition, the smaller the color toner particle diameter, the better image quality such as dot reproducibility. Specifically, a cumulative value of particles each having a circularity of 0.960 or more on a number basis of greater than 60% tends to increase the packing property of the color toner and contamination of the developing sleeve by a releasing agent. Conversely, a cumulative value of particles each having a circularity of 0.960 or more on a number basis of less than 9% tends to reduce the transfer efficiency or to render scattering remarkable.

In the present invention, the average circularity A, the permeability B, the weight average particle diameter X, the cumulative value Y of particles each having a circularity of 0.960 or more on a number basis, and the peak temperature Tsc of the highest endothermic peak are measured as follows. It should be noted that those parameters are measured similarly in each example described below.

<Measurement of Average Circularity A and Cumulative Value Y of Particle Having Circularity of 0.960 or More on Number Basis>

A circle-equivalent diameter and circularity of a color toner, and their frequency distributions are used as simple measures of quantitatively expressing shapes of color toner particles. In the present invention, measurement is carried out by using a flow-type particle image measuring device 'FPIA-2100' (manufactured by Sysmex Corporation), and the circle-equivalent diameter and the circularity are calculated by using the following equations.

Circle-equivalent diameter=(Projected area of a particle/$\pi$)$^{1/2}$×2

Circularity=(Circumferential length of a circle having the same area as that of the projected area of a particle)/(Circumferential length of the projected image of a particle)

where the "projected area of a particle" is defined as an area of a binarized color toner particle image, and the "circumferential length of the projected image of a particle" is defined as a borderline drawn by connecting edge points of the color toner particle image. The circularity in the present invention is an indication for the degree of irregularities of a color toner particle. If the color toner particle is of a complete spherical shape, the circularity is equal to 1.000. The more complicated the surface shape, the lower the value for the circularity.

In the present invention, an average circularity C which indicates an average value of a circularity distribution is calculated from the following equation when a circularity (center value) of a divisional point i of a particle size distribution is denoted by ci and a frequency is denoted by fci.

$$\text{Average circularity } C = \sum_{i=1}^{m} (c_i \times f_{ci}) \Big/ \sum_{i=1}^{m} (f_{ci})$$

A specific measurement method is as follows. 10 ml of ion-exchanged water from which an impurity solid or the like has been removed in advance is charged into a vessel, and a surfactant, preferably an alkyl benzene sulfonate, is added as a dispersant to the water. After that, 0.02 g of a measurement sample is added to the mixture, and is uniformly dispersed. An ultrasonic dispersing unit "Tetora 150" (manufactured by Nikkaki Bios Co., Ltd) is used as a dispersing means, and the dispersion treatment is performed for 2 minutes to prepare a dispersion for measurement. At that time, the dispersion is appropriately cooled so as not to have a temperature of 40° C. or higher.

The flow-type particle image measuring device is used to measure shapes of color toner particles. The concentration of the dispersion is readjusted such that the color toner particle concentration at the time of the measurement is 3,000 to 10,000 particles/μl, and 1,000 or more color toner particles are measured. After the measurement, by using the data, a cumulative value Y of particles each having a circularity of 0.960 or more on a number basis is determined from the average circularity A and circularity frequency distribution of color toner particles, while data for particles each having a particle diameter of 3 μm or less is discarded.

<Permeability B in 45 vol % Aqueous Solution of Methanol>

(i) Preparation of Color Toner Dispersion

An aqueous solution with a methanol-to-water volume mixing ratio of 45:55 is prepared. 10 ml of the aqueous solution is charged into a 30 ml sample bottle (Nichiden-Rika Glass Co., Ltd: SV-30), and 20 mg of the color toner is immersed into the liquid surface, followed by capping the bottle. After that, the bottle is shaken with Yayoi shaker (model: YS-LD) at 150 reciprocating motions/min for 5 seconds. At this time, the angle at which the bottle is shaken is set as follows. A direction right above the shaker (vertical direction) is set to 0°, and a shaking support moves forward by 15° and backward by 20°. Then, the bottle is shaken forward and backward and returned to the direction right above the shaker. This series of motions is counted as one reciprocating motion. The sample bottle is fixed to a fixing holder (prepared by fixing the cap of the sample bottle onto an extension line of the center of the support) attached to the tip of the support. After the sample bottle is taken out, a dispersion after 30 seconds of still standing is provided as a dispersion for measurement.

(ii) Permeability Measurement

The dispersion prepared in (i) is charged into a 1 cm square quartz cell. A permeability (%) of light at a wavelength of 600 nm in the dispersion is measured by using a spectrophotometer MPS 2000 (manufactured by Shimadzu Corporation) 10 minutes after the cell has been loaded into the spectrophotometer (see the following equation).

Permeability $B$ (%)=$I/I_0$×100

(where $I_0$ denotes incident luminous flux, and I denotes transmitted luminous flux.)

<Measurement of Color Toner Particle Diameter>

In the present invention, the average particle diameter and particle diameter distribution of the color toner can be measured by using Coulter Multisizer (manufactured by Beckman Coulter, Inc). A 1% aqueous solution of NaCl prepared by using extra-pure sodium chloride may be used as an electrolyte. For example, ISOTON R-II (manufactured by Coulter Scientific Japan) can be used as a measuring device. A measurement method is as follows. 0.1 to 5 ml of a surfactant, preferably an alkyl benzene sulfonate is added as a dispersant to 100 to 150 ml of the electrolyte. Then, 2 to 20 mg of measurement samples are added to the electrolyte. The electrolyte in which the samples are suspended is subjected to dispersion treatment in an ultrasonic dispersing unit for about 1 to 3 minutes. After that, by using a 100 μm aperture as an aperture, the volume and number of toner particles having a particle diameter of 2.00 μm or more are measured by the measuring device to calculate the volume and number distributions of the toner particles. Then, a weight average particle diameter (D4) (a center value for each channel is defined as a representative value for each channel) is determined.

Used as the channels are 13 channels of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

<Measurement of Highest Endothermic Peak Tsc of Color Toner>

The highest endothermic peak Tsc of the color toner is measured using a differential scanning calorimeter (DSC measuring device), DCS-7 (manufactured by Perkin Elmer, Inc.), or DSC2920 (manufactured by TA Instruments Japan) in conformance with ASTM D3418-82.

5 to 20 mg, preferably 10 mg of the measurement sample is precisely weighted. The measurement sample is put into an aluminum pan, and using an empty aluminum pan as a reference, a temperature of the measurement sample is risen as described below within the measurement range of 30 to 200° C.

Temperature Curve:

Temperature rise I (from 30° C. to 200° C., rate of temperature increase 10° C./min)

Temperature decrease I (from 200° C. to 30° C., rate of temperature decrease 10° C./min)

Temperature rise II (from 30° C. to 200° C., rate of temperature increase 10° C./min)

The highest endothermic peak of the color toner is determined as follows. In the process of temperature increase II, one having, in the range not lower than the endothermic peak at Tg of the color toner, the highest height from the base line is taken as the highest endothermic peak of the color toner of the present invention. Alternatively, in the case where it is difficult to discriminate the endothermic peak at Tg of the color toner since it overlaps another endothermic peak, the highest one of the overlapping peaks is taken as the highest endothermic peak of the color toner of the present invention.

Next, a description is given of a binder resin to be incorporated into the color toner of the present invention.

The binder resin to be incorporated into the color toner of the present invention is preferably selected from the group consisting of the following items (a) to (f):

(a) a polyester resin;

(b) a hybrid resin containing a polyester unit and a vinyl-based polymer unit;

(c) a mixture of a hybrid resin and a vinyl-based polymer;

(d) a mixture of a polyester resin and a vinyl-based polymer;

(e) a mixture of a hybrid resin and a polyester resin; and (f) a mixture of a polyester resin, a hybrid resin, and a vinyl-based polymer. In particular, a binder resin containing a hybrid resin is preferably used.

In the present invention, the term "polyester unit" refers to a part derived from polyester, and the term "vinyl-based polymer unit" refers to a part derived from a vinyl-based polymer. Examples of polyester-based monomers constituting a polyester unit include a polycarboxylic acid component and a polyhydric alcohol component. A vinyl-based monomer constituting a vinyl-based polymer unit is a monomer component having a vinyl group. A monomer having a polycarboxylic acid component and a vinyl group in the monomer, or a monomer having a polyhydric alcohol component and a vinyl group is defined as a "polyester-based monomer".

A molecular weight distribution of the binder resin measured by gel permeation chromatography (GPC) has a main peak (MP) preferably in the molecular weight range of 3,500 to 30,000, more preferably in the molecular weight range of 5,000 to 20,000. In addition, a ratio (Mw/Mn) of a weight average molecular weight (Mw) to a number average molecular weight (Mn) is preferably 5.0 or more.

The presence of a main peak in the molecular weight range below 3,500 tends to deteriorate hot offset resistance of the toner. On the other hand, the presence of a main peak in the molecular weight range above 30,000 tends to deteriorate low temperature fixability of the toner, thereby making it difficult to apply the toner to high-speed fixing. Moreover, Mw/Mn of less than 5.0 makes it difficult to obtain satisfactory offset resistance.

In the present invention, the molecular weight distribution by GPC is measured as follows. It should be noted that the molecular weight distribution is measured similarly in each example described below.

<Measurement of Molecular Weight Distribution by GPC Measurement>

As described below, a molecular weight distribution in a resin component by GPC is determined through measurement by GPC using tetrahydrofuran (THF) soluble matter obtained by dissolving a sample in a THF solvent.

In other words, a sample is placed in THF, and the mixture is left for several hours. After that, the mixture is sufficiently shaken to mix the sample and THF well (until a coalesced product of the sample disappears), and the mixture is left for an additional 12 or more hours. At this time, a period of time during which the sample is left in THF should be 24 hours or more. Then, the mixture is passed through a sample treatment filter (having a pore size of 0.45 to 0.5 μm, for example, Mishoridisk H-25-5 manufactured by Tosoh Corporation or Ekicrodisk 25 CR manufactured by Gelman Science Japan) to prepare a sample for GPC measurement. Moreover, the sample concentration is adjusted such that the amount of the resin component is 0.5 to 5 mg/ml.

GPC measurement of the sample prepared by the above method is as follows. A column is stabilized in a heat chamber at 40° C., and tetrahydrofuran (THF) is flown as a solvent to the column stabilized at the temperature at a flow velocity of 1 ml/min. Then, about 50 to 200 μl of the THF sample solution is injected for measurement. In measuring a molecular weight of the sample, a molecular weight distribution of the sample is calculated from a relationship between a logarithmic value for a calibration curve created by several kinds of monodisperse polystyrene standard samples and a count number (retention time). Examples of a standard polystyrene sample used for creating a calibration curve include a standard polystyrene sample having a molecular weight of $6\times10^2$, $2.1\times10^3$, $4\times10^4$, $1.75\times10^4$, $5.1\times10^4$, $1.1\times10^5$, $3.9\times10^5$, $8.6\times10^5$, $2\times10^6$, or $4.48\times10^6$ (manufactured by Tosoh Corporation or Pressure Chemical Co.). Preferably, at least about 10 standard polystyrene samples are used in combination. An RI (refractive index) detector is used as a detector.

A combination of multiple commercially available polystyrene gel columns is recommended for the column in order to accurately measure a molecular weight region of $10^3$ to $2\times10^6$. Examples of the combination include: a combination of shodex GPC KF-801, 802, 803, 804, 805, 806, and 807 manufactured by Showa Denko; and a combination of μ-styragel 500, $10^3$, $10^4$, and $10^5$ manufactured by Waters.

Next, the materials of the binder resin will be given.

Examples of a polyester-based monomer for forming a polyester resin or a polyester unit include alcohols and carboxylic acid, carboxylic anhydride, and carboxylate, which may be used as a raw material monomer.

Specific examples of a dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of an alcohol component that has three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a carboxylic acid component include: aromatic dicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; succinic acids substituted by an alkyl group having 6 to 12 carbon atoms, and anhydrides thereof; and unsaturated dicarboxylic acids such as fumaric acid, maleic acid, and citraconic acid, and anhydrides thereof.

Of those, particularly preferable are a polyester resin obtained by condensation polymerization using, as a diol component, a bisphenol derivative represented by the following general formula (1) and using, as an acid component, a carboxylic acid component including a divalent or more carboxylic acid, an anhydride thereof, or a lower alkyl ester thereof (such as fumaric acid, maleic acid, maleic anhydride, phthalic acid, terephthalic acid, trimellitic acid, or pyromellitic acid) because the resin exhibits excellent charging property.

(1)

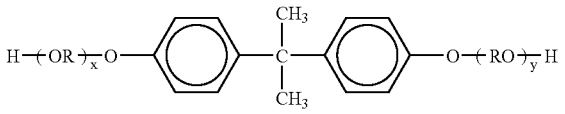

(In the formula, R denotes an ethylene group or a propylene group, x and y each denote an integer of 1 or more, and an average value of x+y is 2 to 10.)

Moreover, in the present invention, further improved releasing agent dispersibility and enhanced low temperature fixability and offset resistance can be expected from the use of a hybrid resin containing a polyester unit and a vinyl-based polymer unit as the binder resin.

The "hybrid resin component" in the binder resin means a resin in which a vinyl-based polymer unit and a polyester unit are chemically bonded to each other. Specifically, the hybrid resin component is a resin formed by an ester exchange between a polyester unit and a vinyl-based polymer unit in which a monomer having a carboxylate group such as meta(acrylate) is polymerized. Preferably, the hybrid resin component forms a graft copolymer (or block copolymer) in which a vinyl-based polymer serves as a backbone polymer and a polyester unit serves as a branch polymer.

Examples of a vinyl-based monomer for forming a vinyl-based resin or a vinyl-based resin unit may include the following: styrene; styrenes such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene and derivatives thereof; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, examples thereof include: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; anhydrides of α,β-unsaturated acids such as crotonic anhydride and cinnamic anhydride; anhydrides of the above-mentioned α,β-unsaturated acids and lower aliphatic acids; and monomers having carboxyl groups such as alkenylmalonic acid, alkenylglutaric acid, and alkenyladipic acid, acid anhydrides thereof, and monoesters thereof.

Further, examples thereof include: acrylates or methacrylates such as 2-hydroxyethyl acrylate, 2-hydroxyethyl methacrylate, and 2-hydroxypropyl methacrylate; and monomers having hydroxyl groups such as 4-(1-hydroxy-1-methylbutyl)styrene and 4-(1-hydroxy-1-methylhexyl)styrene.

The vinyl-based resins or vinyl-based polymer units of the binder resin in the present invention may have a crosslinking structure formed by crosslinking with a crosslinking agent having two or more vinyl groups. The following can be given as examples of the crosslinking agent used in this case.

Examples of aromatic divinyl compounds include divinylbenzene and divinylnaphthalene; examples of diacrylate compounds bonded with an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of each of the aforementioned compounds to "methacrylate"; examples of diacrylate compounds bonded with an alkyl chain containing an ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of each of the aforementioned compounds to "methacrylate"; and examples of diacrylate compounds bonded with a chain containing an aromatic group and an ether bond include polyoxyethylene(2)-2,2-bis(4-hydroxyphenyl)propane diacrylate, polyoxyethylene(4)-2,2-bis(4-hydroxyphenyl)propane diacrylate, and those obtained by changing the "acrylate" of each of the aforementioned compounds to "methacrylate".

Examples of polyfunctional crosslinking agents include pentaerythritol triacrylate, trimethylolethane triacrylate, trimethylolpropane triacrylate, tetramethylolmethane tetraacrylate, oligoester acrylate, and those obtained by changing the "acrylate" of the aforementioned compounds to "methacrylate"; triallyl cyanurate, and triallyl trimellitate.

In the present invention, it is preferable that a vinyl-based polymer component and/or a polyester resin component contain a monomer component that can react with both the resin components. Examples of a monomer that can react with a vinyl-based polymer out of monomers constituting a polyester resin component include: unsaturated dicarboxylic acids such as phthalic acid, maleic acid, citraconic acid, and itaconinc acid; and anhydrides of these acids. Examples of a monomer that can react with a polyester resin component out of monomers constituting a vinyl-based polymer component include: a monomer having a carboxyl group or a hydroxyl group; an acrylate; and a methacrylate.

A preferable method of yielding a reaction product of a vinyl-based polymer and a polyester resin is as follows. One or both of the vinyl-based polymer and the polyester resin is subjected to a polymerization reaction to yield a reaction product in the presence of a polymer containing any of the above-described monomer components that can react with each of the vinyl-based polymer and the polyester resin.

Examples of polymerization initiators to be used in the production of the vinyl polymer of the present invention include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

Next, a method of producing a hybrid resin used in the binder resin of the present invention will be given. The hybrid resin of the present invention can be produced in accordance with the production method shown in the following items (1) to (5) or the like.

(1) After a vinyl-based polymer and a polyester resin are separately produced, the vinyl-based polymer and the polyester resin are dissolved and swelled in a small amount of organic solvent. Then, an esterification catalyst and alcohol are added to the solution, and the whole is heated to carry out an ester exchange reaction for synthesizing a hybrid resin.

(2) After a vinyl-based polymer is produced, a polyester resin and a hybrid resin component are produced in the presence of the vinyl-based polymer. The hybrid resin component is produced through a reaction between a vinyl-based polymer (a vinyl-based monomer may be added as required) and one or both of a polyester monomer (such as alcohol or a carboxylic acid) and the polyester resin. An organic solvent may be appropriately used in this case as well.

(3) After a polyester resin is produced, a vinyl-based polymer and a hybrid resin component are produced in the presence of the polyester resin. The hybrid resin component is produced through a reaction between a polyester unit (a polyester monomer may be added as required) and a vinyl-based monomer.

(4) After a vinyl-based polymer and a polyester resin are produced, one or both of a vinyl-based monomer and a polyester monomer (such as alcohol or a carboxylic acid) is added in the presence of these polymer units to produce a hybrid resin component. An organic solvent may be appropriately used in this case as well.

(5) A vinyl-based monomer and a polyester monomer (such as alcohol or a carboxylic acid) are mixed, and the mixture is continuously subjected to an addition polymerization reaction and a condensation polymerization reaction to produce a vinyl-based polymer unit, a polyester resin, and a hybrid resin component. Furthermore, an organic solvent may be appropriately used.

Furthermore, after a hybrid resin component is produced by each of the production methods described in the items (1) to (4), a vinyl-based polymer and a polyester resin may be added to the component by adding one or both of a vinyl-based monomer and a polyester monomer (such as alcohol or a carboxylic acid) to carry out at least one of an addition polymerization reaction and a condensation polymerization reaction.

In each of the production methods described in the items (1) to (5), multiple polymer units different in molecular weight and in degree of crosslinking may be used for the vinyl-based polymer and the polyester unit.

The binder resin to be incorporated into the color toner of the present invention has a glass transition temperature of preferably 40 to 90° C., more preferably 45 to 85° C. The binder resin has an acid value of preferably 1 to 40 mgKOH/g.

In the present invention, a polyester unit content in the binder resin is desirably in the range of 50 to 100 mass %.

Next, examples of the releasing agent to be used in the present invention include the following.

The examples thereof include: aliphatic hydrocarbon-based waxes such as low molecular weight polyethylene, low molecular weight polypropylene, a microcrystalline wax, a paraffin wax, and a Fischer-Tropsch wax; oxides of aliphatic hydrocarbon-based waxes such as a polyethylene oxide wax; block copolymers of aliphatic hydrocarbon-based waxes; waxes mainly composed of fatty esters such as a carnauba wax and a montanic ester wax; and waxes such as a deoxidized carnauba wax obtained by deoxidizing part or whole of fatty esters.

The examples thereof further include: partially esterified products of fatty acids and polyhydric alcohols such as behenic monoglyceride; and methyl ester compounds having hydroxyl groups obtained through hydrogenation of vegetable fats and oils.

Aliphatic hydrocarbon-based waxes such as a paraffin wax, polyethylene, and a Fischer-Tropsch wax are particularly preferably used because of their short molecular chains, little steric hindrance, and excellent mobility.

A molecular weight distribution of wax has a main peak preferably in the molecular weight range of 350 to 2,400, more preferably in the molecular weight range of 400 to 2,000. Such a molecular weight distribution can impart preferable heat characteristics to the color toner. In addition, a temperature of the highest endothermic peak of the wax is preferably 63° C. or more and less than 105° C., more preferably 70° C. or more and less than 90° C.

The addition amount of the releasing agent to be used in the present invention is preferably 1 to 10 parts by mass, more preferably 2 to 8 parts by mass with respect to 100 parts by mass of the binder resin. An addition amount of less than 1 part by mass is not enough to allow the releasing agent to appear on the color toner surface upon fusing to exert releasability, so that a considerable quantity of heat and considerable pressure are necessary. Conversely, an addition amount in excess of 10 parts by mass results in an excessively large releasing-agent amount in the color toner, so that transparency or a charging property tends to deteriorate.

Next, a description is given of a colorant to be incorporated into the color toner of the present invention.

A pigment and/or a dye may be used as the colorant to be used in the present invention.

Examples of a magenta coloring pigment include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet 19; and C.I. Vat Red 1, 2, 10, 13, 15, 23, 29, and 35.

Although each of the pigments may be used alone, it is preferable to use a dye and a pigment in combination to increase the sharpness of a full-color image from the viewpoint of its image quality.

Examples of a magenta dye include: oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Examples of a cyan coloring pigment as another coloring pigment include: C.I. Pigment Blue 2, 3, 15, 16, and 17; C.I. Vat Blue 6; C.I. Acid Blue 45; and copper phthalocyanine pigments each having a phthalocyanine skeleton to which 1 to 5 phthalimidomethyl groups are added.

Furthermore, examples of a yellow coloring pigment include: C.I. Pigment Yellow 1, 2, 3, 4, 5, 6, 7, 10, 11, 12, 13, 14, 15, 16, 17, 23, 65, 73, 74, 83, 155, and 180; and C.I. Vat Yellow 1, 3, and 20.

The usage amount of the colorant is 0.1 to 60 parts by mass, preferably 0.5 to 50 parts by mass with respect to 100 parts by mass of the binder resin.

A known charge control agent may be incorporated into the color toner of the present invention.

Examples of the charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition to the above compounds, the examples thereof include: carboxylic acid derivatives such as carboxylic acid metal salts, carboxylic anhydrides, and carboxylates; and condensates of aromatic compounds. Each of phenol derivatives such as bisphenols and calixarenes is also used as the charge control agent. However, each of aromatic carboxylic acid metal compounds is preferably used from the viewpoint of rising of charge.

The addition amount of the charge control agent to be used in the present invention is 0.3 to 10 parts by mass, preferably 0.5 to 7 parts by mass with respect to 100 parts by mass of the binder resin.

This is because an addition amount of less than 0.3 parts by mass makes it impossible to obtain the effect of rising of charge and an addition amount of more than 10 parts by mass increases environmental variations.

In addition, a fluidizing agent may be incorporated into the color toner of the present invention.

For instance, if a fluidizing agent or the like is mixed with the color toner in a mixer such as Henschell Mixer after pulverizing and classifying steps, a color toner excellent in flowability can be obtained.

Any fluidizing agent can be used as long as addition of the fluidizing agent to a colorant-containing binder resin particle can increase. flowability as compared to that before the addition. Examples of the fluidizing agent include: a fluorine-based resin powder such as a vinylidene fluoride fine powder or a polytetrafluoroethylene fine powder; a titanium oxide fine powder; an alumina fine powder; finely powdered silica such as wet manufacturing silica or dry manufacturing silica; and treated silica obtained by treating the surface of any of the above with a silane compound, an organosilicon compound, a titanium coupling agent, or silicone oil.

The above dry manufacturing silica is a fine powder produced by vapor-phase oxidation of a silicon halogen compound, which is called dry silica or fumed silica and which is produced by conventionally known techniques. Such known techniques include one that utilizes a thermal decomposition oxidation reaction in oxyhydrogen flame of silicon tetrachloride gas, and a reaction formula that forms a basis for the reaction is as follows.

$$SiCl_4+2H_2+O_2 \rightarrow SiO_2+4HCl$$

In addition, in this production process, other metal halogen compounds such as aluminum chloride and titanium chloride can be used in combination with silicon halogen compounds to yield composite fine powders of silica and other metal oxides, and the composite fine powders are also included in the examples of dry manufacturing silica. With regard to a silica fine powder particle diameter, an average primary particle diameter is desirably within the range of 0.001 to 2 μm. It is particularly preferable to use a silica fine powder with an average primary particle diameter within the range of 0.002 to 0.2 μm.

Used as the titanium oxide fine powder is a titanium oxide fine particle obtained by a sulfuric acid method, by a chlorine method, or by low temperature oxidation (thermal decomposition, hydrolysis) of a volatile titanium compound such as titanium alkoxide, titanium halide, or titanium acetylacetonate. A crystal system of the titanium oxide fine powder may be any one of an anatase type, a rutile type, a mixed crystal type thereof, or an amorphous type.

Used as the alumina fine powder is an alumina fine powder obtained by Bayer process, an improved Bayer process, an ethylene chlorohydrin method, an underwater spark discharge method, hydrolysis of organic aluminum, thermal decomposition of aluminum alum, thermal decomposition of ammonium aluminum carbonate, or flame decomposition of aluminum chloride. A crystal system of the alumina fine powder may be any one of α, β, γ, δ, ξ, η, θ, κ, χ, and ρ types, a mixed crystal type thereof, or an amorphous type. An alumina fine powder of a mixed crystal type of α, δ, γ, and θ types or of an amorphous type is preferably used.

Used as the silica having its surface treated is one obtained by chemical or physical treatment with an organosilicon compound or the like which reacts with or physically adsorbs to an inorganic fine powder. Specifically, a silica fine powder produced by vapor-phase oxidation of a silicon halogen compound is treated with an organosilicon compound. Examples of such an organosilicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethyl polysiloxane having 2 to 12 siloxane units in a molecule and having in a unit positioned at each terminal one hydroxyl group bonded to Si. Each of the above compounds is used alone or a mixture of two or more of them is used.

In addition, the fluidizing agent to be used in the present invention may be prepared by treating the dry manufacturing silica with a coupling agent having an amino group, or silicone oil.

A fluidizing agent to be used in the present invention having a specific surface area of nitrogen adsorption measured by means of a BET method of 30 $m^2/g$ or more, preferably 50 $m^2/g$ or more provides a satisfactory result. A fluidizing agent content is 0.01 to 8 parts by mass, preferably 0.1 to 4 parts by mass with respect to 100 parts by mass of the color toner.

As described above, the color toner of the present invention thus constituted utilizes a binder resin containing a polyester unit with a good charge rising property. At the same time, the value for the permeability B is set to be within a desired range. As a result, sleeve contamination can be mitigated and developability can be synergistically enhanced. Furthermore, the value for the average circularity A is set to be within a desired range, so that transfer efficiency can be improved and the running cost can be reduced. In addition, the value for Tsc in DSC measurement is set to be within a desired range, so that the color toner is excellent in low temperature fixability and can contribute to energy saving.

Moreover, the color toner of the present invention which satisfies the requirement defining the relationship between the weight average particle diameter X and Y showing a ratio of circularity has a suppressed packing property, mitigated sleeve contamination, and enhanced developability.

The color toner which has been descried above can also be preferably used for nonmagnetic mono-component development.

<Two-Component Developer Having Color Toner of the Present Invention>

In the case where the color toner of the present invention is used for a two-component developer, the color toner is mixed with a magnetic carrier before use. Examples of an available magnetic carrier include: surface-oxidized or -unoxidized metallic particles such as iron, lithium, calcium, magnesium, nickel, copper, zinc, cobalt, manganese, chromium, and rare earths; and alloy particles, oxide particles, and ferrites thereof.

A coated carrier obtained by coating the surface of the magnetic carrier particle with a resin can be particularly preferably used in a developing method in which an AC bias is applied to a developing sleeve. Examples of an applicable coating method include conventionally known methods such as: a method in which a coating liquid prepared by dissolving or suspending a coating material such as a resin in a solvent is allowed to adhere to the surface of a magnetic carrier core particle; and a method in which a magnetic carrier core particle and a coating material are mixed in powder form.

Examples of the coating material for the surface of the magnetic carrier core particle include a silicone resin, a polyester resin, a styrene-based resin, an acrylic resin, polyamide, polyvinyl butyral, and an aminoacrylate resin. One or multiple of those resins are used.

The coating amount of the above coating material is preferably 0.1 to 30 mass % (more preferably 0.5 to 20 mass %) with respect to the carrier core particle. Those carriers have an average particle diameter of preferably 10 to 100 μm, more preferably 20 to 70 μm.

In the case where the color toner of the present invention and a magnetic carrier are mixed to prepare a two-component developer, a mixing ratio of the color toner of the present invention and the magnetic carrier is 2 to 15 mass %, preferably 4 to 13 mass % in terms of a color toner concentration in the developer. A toner concentration within such a range ordinarily provides a satisfactory result. A color toner concentration of less than 2 mass % tends to reduce the image density, whereas a color toner concentration in excess of 15 mass % tends to cause fogging or scattering in a machine.

In addition, the use of the color toner of the present invention for one-component development also provides a satisfactory result because the color toner is advantageous with respect to sleeve contamination.

<Production Method for the Color Toner of the Present Invention>

Next, procedures for producing a color toner of the present invention are described.

First, in a raw material mixing step, predetermined amounts of at least a binder resin, a colorant, and a releasing agent are weighted, and then compounded and mixed together as internal additives to the toner. Examples of a mixing device include a double con mixer, a V-type mixer, a drum-type mixer, a Super mixer, Henschell Mixer, and a nauta mixer.

Further, the toner raw materials compounded and mixed as described above are melted and kneaded to melt the binder resin, and the colorant and the like are dispersed in the melted resin. In the melting and kneading step, for example, a batch kneader such as a pressure kneader or a Banbury mixer, or a continuous kneader can be used. In recent years, a uniaxial or biaxial extruder has been becoming mainstream owing to its advantage of allowing continuous production. For example, a KTK series biaxial extruder manufactured by KOBE STEEL, LTD., a TEM series biaxial extruder manufactured by TOSHIBA MACHINE CO., LTD., a biaxial extruder manufactured by KCK Corporation, a co-kneader manufactured by Buss Co., Ltd, and the like are generally used. A precolored resin composition obtained by melting and kneading the toner raw materials is rolled out by two rolls or the like after the melting and kneading step, and then cooled through a cooling step of cooling the composition by water cooling or the like.

Subsequently, the resulting cooled product of the precolored resin composition obtained as described above is usually pulverized into a desired particle size by a pulverizing step. In the pulverizing step, first, the precolored resin composition is roughly pulverized with a crusher, a hammer mill, a feather mill, or the like, followed by further pulverizing with Criptron System manufactured by Kawasaki Heavy Industries, Ltd., Super Rotor manufactured by Nisshin Engineering, or the like. Subsequently, the pulverized products are classified by using a screen classifier, for example, a classifier such as Elbow-Jet classifier (manufactured by NITTESU MINING CO., LTD) employing an inertia classification system or Turboplex classifier (manufactured by Hosokawa Micron Corp.) employing a centrifugal classification system, to obtain classified products having a weight average particle diameter in the range of 4 to 11 μm.

As required, systems such as Hybridization System manufactured by Nara Machinery Co., Ltd. and Mechanofusion System manufactured by Hosokawa Micron Corp., in which surface modification (=sphering) can be performed in the surface modification step, may be used to obtain the classified products.

A preferable production method for the color toner of the present invention is as follows. That is, no mechanical pulverization is performed in the pulverizing step, and an apparatus A shown in FIGS. 2 and 3 that simultaneously performs classification and surface modification treatment by means of mechanical impact force is used after pulverizing with an air-jet pulverizer to thereby obtain classified products having a weight average particle diameter in the range of 4 to 11 μm.

Note that a screen classifier such as HIBOLTA that is a wind screen (manufactured by Shin Tokyo Kikai Corporation) may be used as necessary. In addition, when treating with external additives, predetermined amounts of the classified toner and known various external additives are compounded and a high-speed stirrer that applies shearing force to a powder, such as Henschell Mixer or Super mixer is used as an external adding machine. Then, the classified toner and the external additives can be stirred and mixed to obtain the color toner of the present invention.

The above apparatus A to be used in the present invention is described in detail below.

Figure 2:
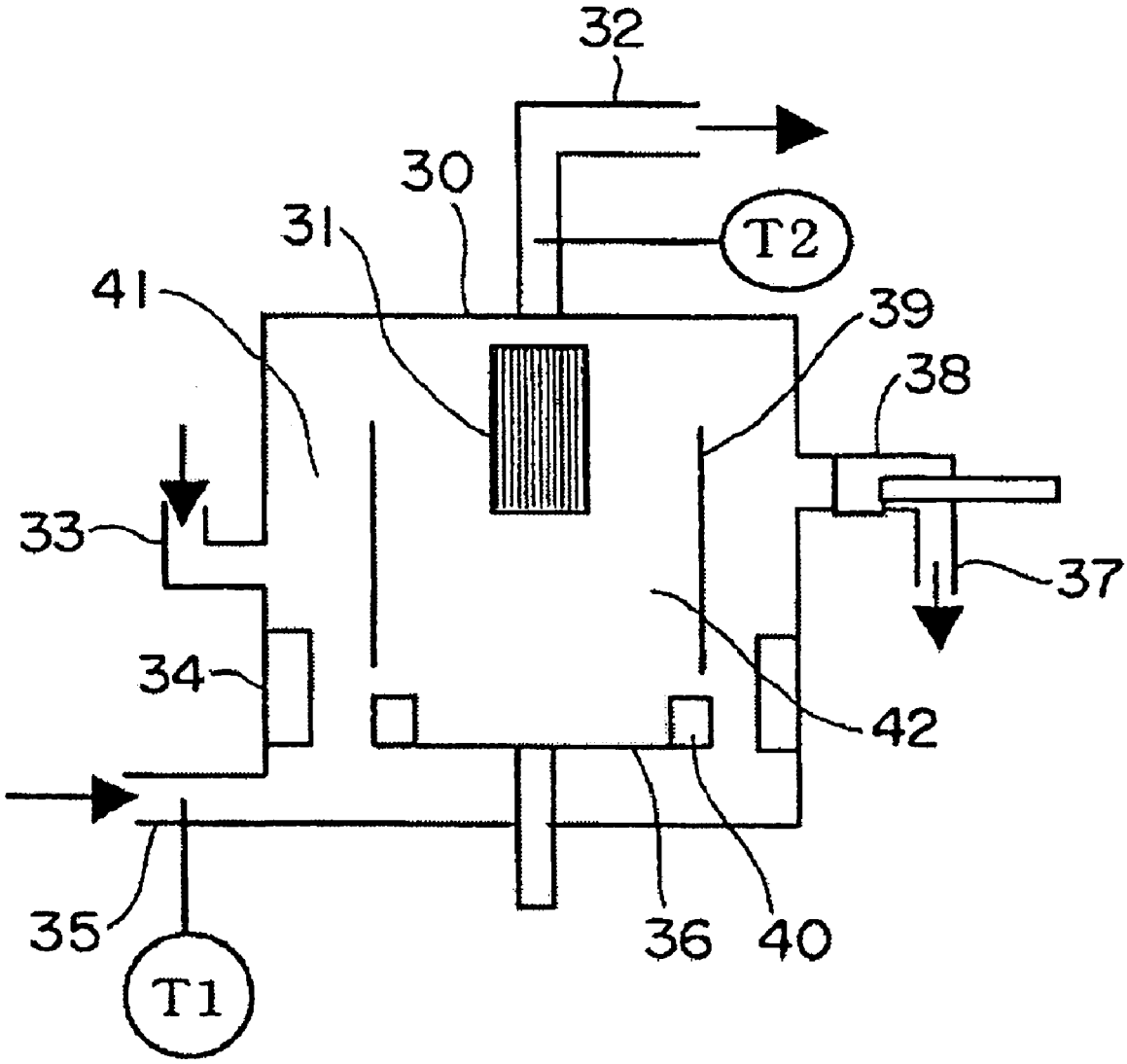
FIG. 2 is a schematic view showing an example of a surface modification apparatus to be used in producing a color toner of the present invention.

The batch-type surface modification apparatus shown in FIG. 2 includes: a casing 30; a jacket (not shown) through which cooling water or an antifreeze can pass; a dispersion rotor 36 (a surface modification means, also see FIG. 3) which is a disk-like body and rotates at a high speed, the dispersion rotor 36 being placed in the casing 30 and attached to a central rotation axis thereof, and having on its top face multiple square disks or cylindrical pins 40; liners 34 arranged on an outer periphery of the dispersion rotor 36 at constant intervals and each having on its surface a large number of grooves (the liner surface may be groove-free); a classifying rotor 31 as a means for classifying raw materials subjected to surface modification into materials each having a predetermined particle size; a cold air introduction port 35 for introducing cold air; a raw material supply port 33 for introducing raw materials to be treated; a discharge valve 38 openably and closably arranged to enable a surface modification time period to be freely adjusted; a powder discharge port 37 for discharging powders after the treatment; a fine powder discharge port 32 for discharging fine powders; and a cylindrical guide ring 39 as a guide means that divides a space between the classifying rotor 31 as the classifying means and the dispersion rotor 36, and the liners 34 as the surface modification means into a first space 41 before introduction into the classifying means and a second space 42 for introducing particles from which fine powders are classified and removed by the classifying means into a surface treatment means. A gap between the dispersion rotor 36 and each of the liners 34 is a surface modification zone, and a gap between the classifying rotor 31 and the periphery of the rotor is a classifying zone.

As described above, the batch-type surface modification apparatus includes: a classifying means that continuously discharges fine powders each having a particle size equal to or less than a predetermined particle size to the outside of the apparatus; a surface treatment means that utilizes mechanical impact force; and a guide means that divides a space between the classifying means and the surface treatment means into a first space before introduction into the classifying means and a second space for introducing particles from which fine powders are classified and removed by the classifying means into the surface treatment means.

Furthermore, a color toner which has a desired shape and performance, and which is subjected to surface modification treatment can be obtained by performing a step of repeating classification and surface modification treatment by means of mechanical impact force for a predetermined period of time, the step being performed by: introducing finely pulverized products into the first space; introducing the finely pulverized products into the surface treatment means which utilizes mechanical impact force via the second space to be subjected to surface modification treatment while continuously discharging and removing fine powders each having a particle size equal to or less than a predetermined particle size to the outside of the apparatus; and circulating the finely pulverized products subjected to surface modification treatment to the first space again.

Figure 3:
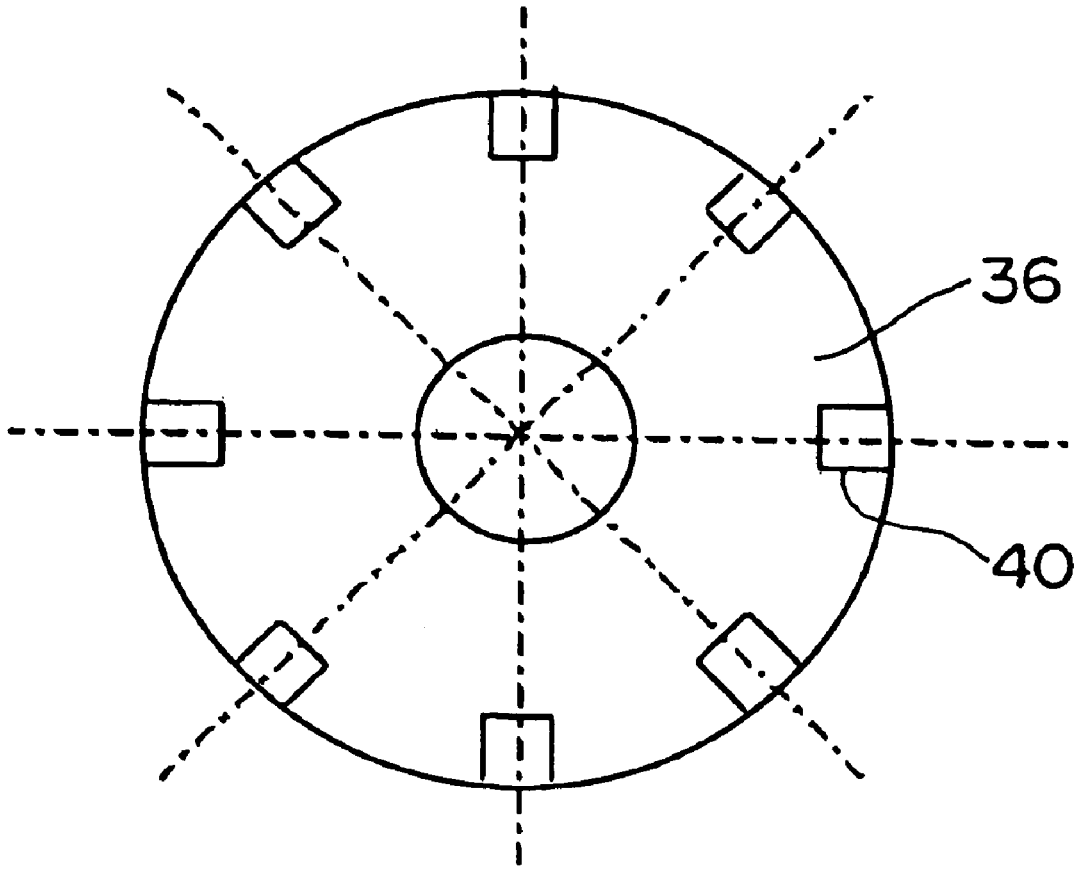
FIG. 3 is a schematic view showing an example of a top view of a dispersion rotor shown in FIG. 2.

The above step is described more specifically with reference to FIGS. 2 and 3.

When an article to be finely pulverized is introduced from the raw material supply port 33 with the discharge valve 38 closed, first, the introduced article to be finely pulverized is sucked in by a blower (not shown) and then subjected to classification by the classifying rotor 31. At this time, fine powders classified as having particle sizes equal to or smaller than a predetermined particle size are continuously discharged and removed from the apparatus to the exterior. Coarse powders having particle sizes equal to or larger than the predetermined particle size are carried on a circulation flow generated by the dispersion rotor 36 while moving along an inner periphery (second space 42) of the guide ring 39 owing to centrifugal force, to be introduced to the surface modification zone. The powders introduced into the surface modification zone are subjected to surface modification treatment by receiving mechanical impact force between the dispersion rotor 36 and the liner 34. The surface-modified particles are carried on cold air passing through inside the apparatus, to be transported along the outer periphery (first space 41) of the guide ring 39 to reach the classification zone. By the classifying rotor 31, the fine powers are discharged again to the outside of the apparatus whereas the coarse powders are carried on the circulation flow to be returned again to the surface modification zone where the surface modifying operation is repeated therefor. Then, after a given period of time has elapsed, the discharge valve 38 is opened to collect the surface-modified particles from the discharge port 37.

Upon examination, the inventors of the present invention have found that a period of time until the opening of the discharge valve (cycle time) and the number of revolutions of the dispersion rotor are important in controlling a sphericity and a releasing-agent amount on the surface. To increase the sphericity, it is effective to make the cycle time longer or to increase a peripheral speed of the dispersion rotor. Further, to restrain the releasing-agent amount on the surface, conversely, it is effective to make the cycle time shorter or to lower the peripheral speed. Since sphering cannot be effectively performed especially unless the peripheral speed of the dispersion rotor is increased to be faster than a predetermined speed, it is necessary to lengthen the cycle time. At this time, it is necessary to set the peripheral speed and the cycle time taking in consideration the relationship with the releasing-agent amount on the surface. According to the present invention, it is effective to set the peripheral speed to be not lower than $1.2\times10^5$ mm/sec and the cycle time to be within the range of 5 to 60 seconds.

EXAMPLES

Hereinafter, specific examples of the present invention will be explained in detail, but the present invention is not limited to the examples.

Hybrid Resin Production Example

Placed in a dropping funnel were 2.0 mol of styrene, 0.21 mol of 2-ethylhexyl acrylate, 0.14 mol of fumaric acid, and 0.03 mol of a dimer of α-methylstyrene as monomers for forming a vinyl-based polymer unit, and 0.05 mol of dicumyl peroxide as a polymerization initiator. Furthermore, placed in a 4 l four-necked flask made of glass were 7.0 mol of polyoxypropylene(2.2)-2,2-bis(4-hydroxyphenyl)propane, 3.0 mol of polyoxyethylene(2.2)-2,2-bis(4-hydroxyphenyl)propane, 3.0 mol of terephthalic acid, 1.9 mol of trimellitic anhydride, and 5.0 mol of fumaric acid as monomers for forming a polyester unit, and 0.2 g of dibutyltin oxide as a catalyst. After that, a thermometer, a stirring bar, a condenser, and a nitrogen introducing pipe were installed on the flask, and the flask was placed in a mantle heater. Subsequently, air in the flask was substituted by nitrogen gas, and the mixture in the flask was gradually heated while being stirred. Then, the vinyl-based monomers and the polymerization initiator were dropped from the dropping funnel for 4 hours to the flask while the mixture in the flask was being stirred at 145° C. Next, the mixture in the flask was heated to 200° C., and was reacted for 4 hours to yield a hybrid resin. Table 1 shows molecular weight measurements by GPC.

Polyester Resin Production Example

Placed in a 4 l four-necked flask made of glass were 3.6 mol of polyoxypropylene(2.2)-2,2-bis(4-hydroxyphenyl)propane, 1.6 mol of polyoxyethylene(2.2)-2,2-bis(4-hydroxyphenyl)propane, 1.7 mol of terephthalic acid, 1.4 mol of trimellitic anhydride, 2.4 mol of fumaric acid, and 0.12 g of dibutyltin oxide. After that, a thermometer, a stirring bar, a condenser, and a nitrogen introducing pipe were installed on the flask, and the flask was placed in a mantle heater. The mixture in the flask was reacted for 5 hours at 215° C. in a nitrogen atmosphere to yield a polyester resin. Table 1 shows molecular weight measurements by GPC.

Styrene-Acrylic Resin Production Example

| | |
|---|---|
| Styrene | 70 parts by mass |
| n-butyl acrylate | 24 parts by mass |
| Monobutyl maleate | 6 part by mass |
| Di-t-butyl peroxide | 1 part by mass |

While 200 parts by mass of xylene was stirred in a four-necked flask, air in the flask was sufficiently substituted by nitrogen. Then, the flask was heated to 120° C., and each of the above components was dropped into the flask for 3.5 hours. Furthermore, polymerization of the components was completed in xylene reflux, and then the solvent was removed by distillation under a reduced pressure to yield a styrene-acrylic resin. Table 1 shows molecular weight measurements by GPC.

TABLE 1

| | Molecular Weight Measurements (GPC) | | | |
|---|---|---|---|---|
| | Mw ($\times10^3$) | Mn ($\times10^3$) | Mp ($\times10^3$) | Mw/Mn |
| Hybrid Resin | 82.0 | 3.2 | 15.5 | 25.63 |
| Polyester Resin | 26.5 | 3.5 | 7.5 | 7.57 |
| Styrene-Acrylic Resin | 80.4 | 6.7 | 10.0 | 12.0 |

Next, Table 2 shows the waxes used in this example.

TABLE 2

| | Highest Endothermic Peak Temperature | Kind of Wax |
|---|---|---|
| Wax (A) | 75.0° C. | Refined Normal Paraffin |
| Wax (B) | 88.0° C. | Refined Fischer-Tropsch |
| Wax (C) | 70.2° C. | Refined Normal Paraffin |
| Wax (D) | 63.8° C. | Refined Normal Paraffin |
| Wax (E) | 103.1° C. | Fischer-Tropsch |
| Wax (F) | 110.1° C. | Polyethylene |
| Wax (G) | 60.0° C. | Refined Normal Paraffin |

Example 1

A toner 1 was prepared according to the following method.

| | |
|---|---|
| Hybrid resin | 100 parts by mass |
| Wax A | 3 parts by mass |
| Aluminum 1,4-di-t-butylsalicylate Compound | 2 parts by mass |
| Cyan pigment (Pigment Blue 15:3) | 5 parts by mass |

After the above prescribed materials had been sufficiently premixed in Henschell Mixer, the mixture was melted and kneaded in a biaxial extruding kneader. The resultant kneaded product was cooled and then roughly pulverized with a hammer mill into products each having a size of about 1 to 2 mm. Then, the resultant roughly pulverized products were finely pulverized with an air-jet pulverizer into products each having a size of 20 μm or less. As shown in Table 3, the resultant finely pulverized products were further pulverized in the apparatus A shown in FIGS. 2 and 3 capable of performing classification and surface modification treatment by means of mechanical impact force at the same time, and cyan particles 1 (classified products) were obtained under the production conditions shown in Table 3.

1.0 part by mass of acicular titanium oxide fine powders (MT-100 T: available from Tayca, BET=62 $m^2/g$, treated with 10 mass % of an isobutyl silane coupling agent) were externally added to 100 parts by mass of the resultant cyan particles in Henschell Mixer to produce a cyan toner 1. The cyan toner 1 had a weight average particle diameter of 7.0 μm, an average circularity A of 0.925, and a cumulative value Y of particles each having a circularity of 0.960 or more on a number basis of 24.0%. Furthermore, the permeability B in a 45 vol % aqueous solution of methanol at this time was 30%.

Furthermore, the cyan toner 1 and magnetic ferrite carrier particles with silicone resin-coated surfaces (having a volume average particle diameter of 45 μm: Mn—Mg ferrite) were mixed to a toner concentration of 7.0 mass % to thereby prepare a two-component cyan developer 1. Table 4 shows the measurements of the developer.

Evaluation of a 10,000-sheet endurance test for original manuscripts each having an image area ratio of 5% was carried out in a monochrome mode and under a normal-temperature and low-humidity environment (23° C./5%) by using the two-component cyan developer 1 and a remodeled device of a color copying machine CLC-1000 (manufactured by Canon) obtained by removing an oil application mechanism in a fixing unit. Obtained was a cyan image which showed a small charge variation as compared to an early stage even after the 10,000-sheet endurance, which posed no problems in terms of cleaning property and sleeve contamination, and which was free of fogging. Furthermore, the transfer efficiency, scattering, fixable range, and blocking resistance were separately evaluated, and any of them showed a satisfactory result as shown in Table 4.

FIG. 1 shows the relationship between a weight average particle diameter X and a cumulative value Y of particles each having a circularity of 0.960 or more on a number basis of the toner produced in this example.

A method of measuring a frictional charge amount and criteria for each evaluation used in this example are as follows.

<Method of Measuring Frictional Charge Amount of Color Toner>

Figure 4:
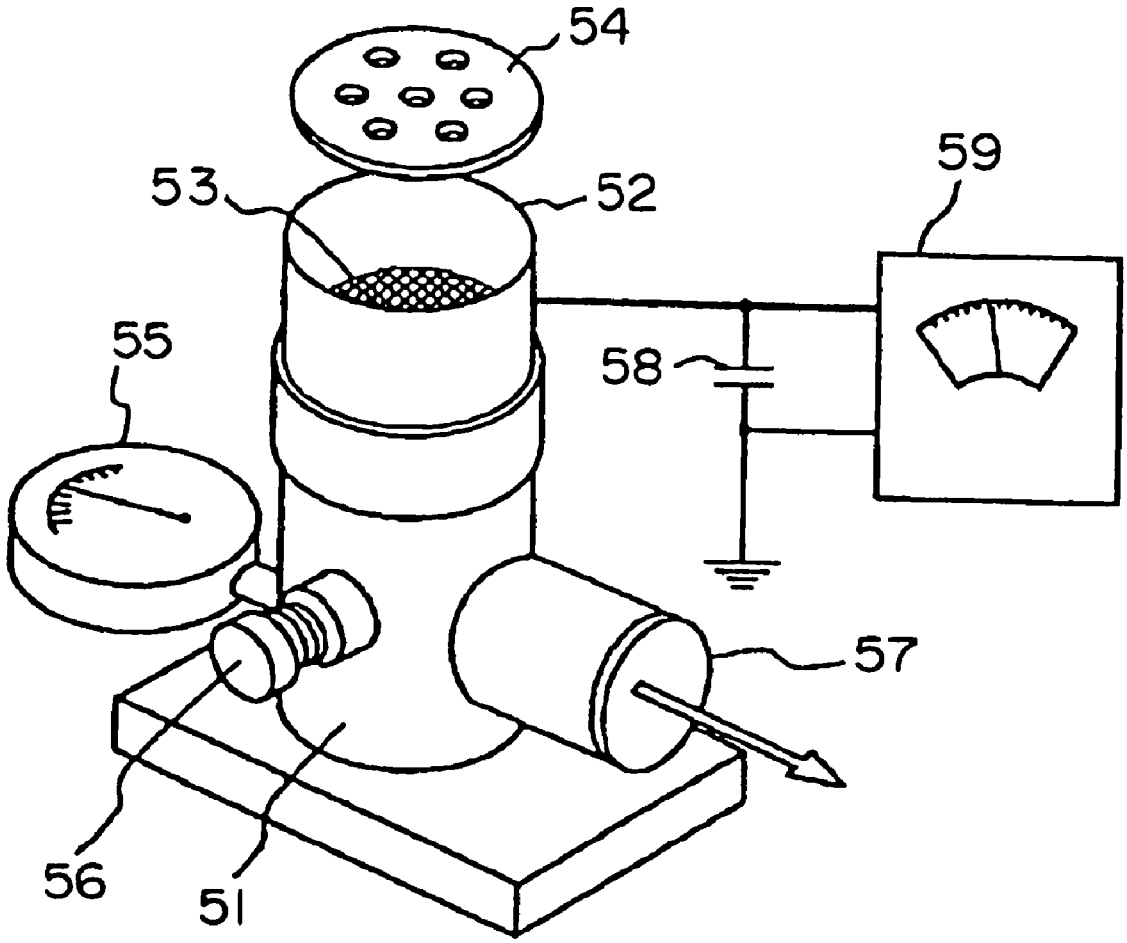
FIG. 4 is a schematic view showing an example of an apparatus for measuring a frictional charge amount of a toner.

FIG. 4 schematically shows an apparatus for measuring a frictional charge amount. About 0.5 to 1.5 g of a two-component developer collected from a developing sleeve is charged into a metallic measuring vessel 52 equipped with a 500-mesh screen 53 at its bottom, and a metallic lid 54 is put on the metallic measuring vessel 52. The weight of the whole measuring vessel 52 at this time is measured and denoted by W1 (kg). Subsequently, the toner in the developer is sucked through a suction hole 57 in a suction unit 51 (at least a part of the suction unit 51 in contact with the measuring vessel 52 is an insulator) while an air quantity control valve 56 is adjusted to allow a vacuum gauge 55 to indicate 250 mmAq. In this state, suction is performed for a sufficient period of time, preferably for 2 minutes to suck and remove the toner. The electric potential of a potentiometer 59 at this time is denoted by V (volt). In this figure, reference numeral 58 denotes a condenser with a capacity of C (mF). Furthermore, the weight of the whole measuring vessel after the suction is measured and denoted by W2 (kg). The frictional charge amount (mC/kg) of this sample is calculated from the following equation.

$$\text{Frictional charge amount of sample (mC/kg)} = C \times V / (W1 - W2)$$

Criteria for evaluation of a charge variation during a period from the start of the 10,000-sheet endurance to the end are as follows.

A: Less than 2 mC/kg

B: 2 mC/kg or more and less than 4 mC/kg

C: 4 mC/kg or more and less than 6 mC/kg

D: 6 mC/kg or more and less than 8 mC/kg

E: 8 mC/kg or more

<Transfer Efficiency>

The color copying machine CLC-1000 (manufactured by Canon) and a chart capable of forming multiple circle or belt images were used. A tape was put on a transfer residual portion on the drum and then affixed to paper. A toner density in the tape was denoted by D1. Then, a tape was put on the toner transferred to paper and a toner density in the tape was denoted by D2. Transfer efficiency was calculated from the following equation.

$$\text{Transfer Efficiency(\%)} = D2/(D1+D2) \times 100$$

A: 96% or more

B: 93% or more and less than 96%

C: 90% or more and less than 93%

D: 87% or more and less than 90%

E: Less than 87%

<Fixable Range>

A fixing test was performed by using a remodeled device of a fixing device in Laser Jet 4100 (manufactured by Hewlett Packard) in a state where the fixing temperature of a fixing unit could be manually set. The fixing temperature was increased from 120° C. in 10° C. increments, and a temperature width in which neither offset nor winding occurred was defined as a fixable range. An unfixed image was formed under a normal-temperature and normal-humidity environment (23° C./60%) through the use of CLC-1000 by adjusting a developing contrast in such a manner that a toner loading on paper would be 1.2 $mg/cm^2$ in a monochrome mode. The image was an image with an area ratio of 25% and TKCLA 4 (manufactured by Canon) was used as transfer paper.

A: The fixable temperature width is 40° C. or more.

B: The fixable temperature width is 30° C. or more and less than 40° C.

C: The fixable temperature width is 20° C. or more and less than 30° C.

D: The fixable temperature width is less than 20° C.

E: No fixable temperature width is observed.

<Scattering>

A horizontal line pattern in which 4-dot horizontal lines were printed at intervals of 176 dot spaces was evaluated for image scattering by using the image output testing machine.

A: Nearly no image scattering is observed even in magnified observation.

B: A low level of image scattering is observed even in magnified observation.

C: Image scattering causes some degree of blurring of characters.

D: Image scattering causes an uneven line thickness.

E: Image scattering causes collapse of part of fine characters.

<Cleaning Property>

The time at which a longitudinal stripe or a spot resulting from residual toner was observed on the image in the 10,000-sheet endurance test corresponds to the occurrence of cleaning failure.

A: No image defect is observed.

B: 1 to 3 spot-like patterns appear.

C: Slight spot-like or stripe-like patterns appear.

D: Spot-like and stripe-like patterns and density unevenness appear.

E: Contamination has a large influence, and density unevenness and charge unevenness appear to result in an irregular image.

<Blocking Resistance>

About 10 g of toner was charged into a 100 ml polycup and left at rest at 50° C. for 3 days, followed by visual observation.

A: No aggregate is observed.

B: A slight aggregate is observed but easily loses its shape.

C: An aggregate is observed but easily loses its shape.

D: An aggregate is observed but loses its shape when it is shaken.

E: An aggregate can be held and does not easily lose its shape.

<Fogging Measurement>

After the completion of the endurance test, fogging was evaluated. Fogging was measured as follows.

For a cyan image, an average reflectivity Dr (%) of plain paper before image output was measured with a reflectometer ("REFLECTOMETER MODEL TC-6DS" manufactured by Tokyo Denshoku) equipped with an amber filter. In the meantime, a solid white image was outputted on the plain paper and a reflectivity Ds (%) of the solid white image was measured. Fogging (Fog (%)) was calculated from the following equation.

$$\text{Fog}(\%)=Dr(\%)-Ds(\%)$$

For a magenta image, the above measurement was performed with a green filter to calculate fogging. For a yellow image, the above measurement was performed with a blue filter to calculate fogging.

A: Less than 0.7%

B: 0.7% or more and less than 1.2%

C: 1.2% or more and less than 1.5%

D: 1.5% or more and less than 2.0%

E: 2.0% or more

<Sleeve Contamination>

A tape was put on a developing sleeve before supplying a developer, and a reflection density of the tape affixed to paper was defined as Dini.

The developer was supplied and the 10,000-sheet endurance test was completed. After that, the developer was recovered from the bottom of a toner tank in a developing unit while the developing sleeve was idly rotated. Then, a tape was put on the toner remaining on the developing sleeve, and a reflection density of the tape affixed to paper was defined as Dlast. The reflection densities were measured with a reflection densitometer X-RITE 500 series (X-Rite, Inc.).

A difference between the density in the tape on the developing sleeve before the endurance and that after the endurance was calculated from the following equation and regarded as Sl contamination.

$$\text{Sleeve contamination}=Dini-Dlast$$

TABLE 3

| | Constitution | | Apparatuses | | | | Toner Physical Properties after External Addition | | | | |
|---|---|---|---|---|---|---|---|---|---|---|---|
| | Binder Resin | Releasing Agent | Pulverizer | Classifier | Peripheral Speed when Apparatus A is Used | Cycle Time when Apparatus A is used | Average Circularity | X | Y | Permeability | Tsc |
| Cyan Toner 1 | Hybrid Resin | Wax A | Air | Apparatus A | $1.20 \times 10^5$ | 30 | 0.925 | 7.0 | 24 | 30 | 76.0 |
| Cyan Toner 2 | Hybrid Resin | Wax B | Air | Apparatus A | $1.35 \times 10^5$ | 50 | 0.945 | 6.7 | 30 | 50 | 89.0 |
| Cyan Toner 3 | Hybrid Resin | Wax C | Air | Apparatus A | $1.20 \times 10^5$ | 15 | 0.920 | 8.5 | 20 | 15 | 71.0 |
| Cyan Toner 4 | Hybrid Resin | Wax C | Air | Apparatus A | $1.35 \times 10^5$ | 60 | 0.953 | 7.5 | 22 | 70 | 71.1 |
| Cyan Toner 5 | Hybrid Resin | Wax B | Air | Apparatus A | $1.20 \times 10^5$ | 10 | 0.916 | 9.5 | 17 | 10 | 90.0 |
| Cyan Toner 6 | Hybrid Resin | Wax D | Air | Apparatus A | $1.20 \times 10^5$ | 10 | 0.915 | 7.1 | 26 | 14 | 67.0 |
| Cyan Toner 7 | Hybrid Resin | Wax E | Air | Apparatus A | $1.42 \times 10^5$ | 60 | 0.960 | 7.0 | 60 | 68 | 104.8 |
| Cyan Toner 8 | Polyester Resin + Hybrid Resin | Wax B | Air | Apparatus A | $1.20 \times 10^5$ | 10 | 0.917 | 11.0 | 9 | 10 | 104.9 |
| Cyan Toner 9 | Polyester Resin | Wax B | Air | Apparatus A | $1.20 \times 10^5$ | 30 | 0.922 | 7.5 | 19 | 70 | 104.7 |
| Yellow Toner 1 | Hybrid Resin | Wax A | Air | Apparatus A | $1.20 \times 10^5$ | 30 | 0.926 | 7.2 | 23.5 | 25 | 76.0 |
| Magenta Toner 1 | Hybrid Resin | Wax A | Air | Apparatus A | $1.20 \times 10^5$ | 30 | 0.924 | 7.1 | 25 | 28 | 76.1 |
| Cyan Toner 10 | Polyester Resin | Wax B | Super Rotor | Elbow-Jet | — | — | 0.928 | 7.0 | 24 | 80 | 89.9 |

TABLE 3-continued

| | Constitution | | Apparatuses | | | | Toner Physical Properties after External Addition | | | | |
|---|---|---|---|---|---|---|---|---|---|---|---|
| | Binder Resin | Releasing Agent | Pulverizer | Classifier | Peripheral Speed when Apparatus A is Used | Cycle Time when Apparatus A is used | Average Circularity | X | Y | Permeability | Tsc |
| Cyan Toner 11 | Polyester Resin | Wax B | Air | Elbow-Jet + Hybridizer | — | — | 0.925 | 6.8 | 28 | 85 | 89.8 |
| Cyan Toner 12 | Polyester Resin | Wax B | Air | Elbow-Jet + Thermal Sphering | — | — | 0.945 | 7.5 | 30 | 95 | 89.8 |
| Cyan Toner 13 | Styrene-Acrylic Resin | Wax B | Air | Apparatus A | $1.20 \times 10^5$ | 30 | 0.925 | 7.1 | 26 | 20 | 89.9 |
| Cyan Toner 14 | Polyester Resin | Wax F | Air | Apparatus A | $1.20 \times 10^5$ | 15 | 0.915 | 7.3 | 27 | 8 | 113.0 |
| Cyan Toner 15 | Polyester Resin | Wax G | Air | Apparatus A | $1.20 \times 10^5$ | 30 | 0.925 | 7.4 | 27.5 | 80 | 60.1 |
| Cyan Toner 16 | Polyester Resin | Wax D | Air | Elbow-Jet | — | — | 0.909 | 7.1 | 8 | 12 | 67.1 |

TABLE 4

| | | | Evaluation after 10,000-Sheet Endurance | | | | Transfer | Fixable | | |
|---|---|---|---|---|---|---|---|---|---|---|
| | | | Charge Variation | Fogging | Cleaning | Sleeve Contamination | Efficiency | Temperature Range | Scattering | Blocking Resistance |
| Example 1 | Two-Component Cyan Developer 1 | Cyan Toner 1 | A | A | A | A | A | A | A | A |
| Example 2 | Two-Component Cyan Developer 2 | Cyan Toner 2 | B | A | B | B | A | B | A | A |
| Example 3 | Two-Component Cyan Developer 3 | Cyan Toner 3 | B | A | A | A | B | B | A | B |
| Example 4 | Two-Component Cyan Developer 4 | Cyan Toner 4 | B | B | C | C | A | A | A | B |
| Example 5 | Two-Component Cyan Developer 5 | Cyan Toner 5 | A | A | A | A | C | C | B | A |
| Example 6 | Two-Component Cyan Developer 6 | Cyan Toner 6 | C | B | A | A | C | B | A | C |
| Example 7 | Two-Component Cyan Developer 7 | Cyan Toner 7 | C | B | C | C | A | B | A | A |
| Example 8 | Two-Component Cyan Developer 8 | Cyan Toner 8 | A | A | A | A | C | C | C | A |
| Example 9 | Two-Component Cyan Developer 9 | Cyan Toner 9 | C | C | C | C | A | B | A | A |
| Example 10 | Two-Component Yellow Developer 1 | Yellow Toner 1 | A | A | A | A | A | A | A | A |
| Example 11 | Two-Component Magenta Developer 1 | Magenta Toner 1 | A | A | A | A | A | A | A | A |
| Comparative Example 1 | Two-Component Cyan Developer 10 | Cyan Toner 10 | D | D | A | D | A | A | A | C |
| Comparative Example 2 | Two-Component Cyan Developer 11 | Cyan Toner 11 | E | D | A | D | A | A | A | C |
| Comparative Example 3 | Two-Component Cyan Developer 12 | Cyan Toner 12 | E | D | E | E | A | A | A | D |
| Comparative Example 4 | Two-Component Cyan Developer 13 | Cyan Toner 13 | E | E | A | A | A | B | A | A |
| Comparative Example 5 | Two-Component Cyan Developer 14 | Cyan Toner 14 | C | C | A | A | C | D | A | A |
| Comparative Example 6 | Two-Component Cyan Developer 15 | Cyan Toner 15 | E | E | A | D | A | A | A | E |
| Comparative Example 7 | Two-Component Cyan Developer 16 | Cyan Toner 16 | B | B | A | A | D | B | A | C |

Example 2

A cyan toner 2 was produced in substantially the same manner as in Example 1 except that the wax B was used and the production conditions were altered as shown in Table 3. A two-component cyan developer 2 was prepared by using the cyan toner 2 produced, and was evaluated for various items in the same manner as in Example 1. As shown in Table 4, the results of this example were satisfactory although the cleaning, fixable range, sleeve contamination, and charge variation of this example were slightly poor.

Example 3

A cyan toner 3 was produced in substantially the same manner as in Example 1 except that the wax C was used and the production conditions were altered as shown in Table 3. A two-component cyan developer 3 was prepared by using the cyan toner 3 produced, and was evaluated for various items in the same manner as in Example 1. As shown in Table 4, the results of this example were satisfactory although the transfer efficiency, fixable range, blocking, and charge variation of this example were slightly poor.

Example 4

A cyan toner 4 was produced in substantially the same manner as in Example 3 except that the production conditions were altered. A two-component cyan developer 4 was prepared by using the cyan toner 4 produced, and was evaluated for various items in the same manner as in Example 1. As shown in Table 4, the cleaning property, sleeve contamination, blocking, and charge variation of this example were poor, but satisfactory results were obtained for the other items. In other words, this example generally showed satisfactory results.

Example 5

A cyan toner 5 was produced in substantially the same manner as in Example 2 except that the production conditions were altered. A two-component cyan developer 5 was prepared by using the cyan toner 5 produced, and was evaluated for various items in the same manner as in Example 1. As shown in Table 4, the transfer efficiency, fixable range, and scattering of this example were poor, but satisfactory results were obtained for the other items. In other words, this example generally showed satisfactory results.

Example 6

A cyan toner 6 was produced in substantially the same manner as in Example 1 except that the wax D was used and the production conditions were altered as shown in Table 3. A two-component cyan developer 6 was prepared by using the cyan toner 6 produced, and was evaluated for various items in the same manner as in Example 1. As shown in Table 4, this example generally showed satisfactory results although the transfer efficiency, fixable range, blocking, charge variation, and fogging of this example were poor.

Example 7

A cyan toner 7 was produced in substantially the same manner as in Example 1 except that the wax E was used and the production conditions were altered. A two-component cyan developer 7 was prepared by using the cyan toner 7 produced, and was evaluated for various items in the same manner as in Example 1. As shown in Table 4, this example generally showed satisfactory results although the cleaning, fixable range, sleeve contamination, charge variation, and fogging of this example were poor.

Example 8

A cyan toner 8 was produced in substantially the same manner as in Example 2 except that 50 parts of polyester resin and 50 parts of hybrid resin were used as the resin and the production conditions were altered as shown in Table 3. A two-component cyan developer 8 was prepared by using the cyan toner 8 produced, and was evaluated for various items in the same manner as in Example 1. As shown in Table 4, this example generally showed satisfactory results although the transfer efficiency, fixable range, and scattering of this example were poor.

Example 9

A cyan toner 9 was produced in substantially the same manner as in Example 2 except that the polyester resin was used and the production conditions were altered as shown in Table 3. A two-component cyan developer 9 was prepared by using the cyan toner 9 produced, and was evaluated for various items in the same manner as in Example 1. As shown in Table 4, this example generally showed satisfactory results although the cleaning, fixable range, sleeve contamination, charge variation, and fogging of this example were poor.

Example 10

A yellow toner 1 was produced in substantially the same manner as in Example 1 except that Pigment Yellow 180 was used as shown in Table 3. A two-component yellow developer 1 was prepared by using the yellow toner 1 produced, and was evaluated for various items in the same manner as in Example 1. As shown in Table 4, the results of this example were satisfactory.

Example 11

A magenta toner 1 was produced in substantially the same manner as in Example 1 except that Pigment Red 122 was used as shown in Table 3. A two-component magenta developer 1 was prepared by using the magenta toner 1 produced, and was evaluated for various items in the same manner as in Example 1. As shown in Table 4, the results of this example were satisfactory.

Comparative Example 1

A cyan toner 10 was produced in substantially the same manner as in Example 9 except that sphering was performed by using Super Rotor manufactured by Nisshin Engineering Inc. and a classifier (Elbow-Jet classifier) that did not perform sphering instead of the apparatus A. A two-component cyan developer 10 was prepared by using the cyan toner 10 produced, and was evaluated for various items in the same manner as in Example 1. As shown in Table 4, the sleeve contamination, charge variation, and fogging of this example were poor.

Comparative Example 2

A cyan toner 11 was produced in substantially the same manner as in Example 9 except that sphering was performed by using the classifier (Elbow-Jet classifier) that did not perform sphering and Hybridization System manufactured by Nara Machinery Co., Ltd. instead of the apparatus A. A two-component cyan developer 11 was prepared by using the cyan toner 11 produced, and was evaluated for various items in the same manner as in Example 1. As shown in Table 4, the sleeve contamination, charge variation, and fogging of this example were poor.

Comparative Example 3

A cyan toner 12 was produced in substantially the same manner as in Example 9 except that sphering was performed by using the classifier (Elbow-Jet classifier) that did not perform sphering and Therfusing System manufactured by Nippon Pneumatic Mfg. Co., Ltd. instead of the apparatus A. A two-component cyan developer 12 was prepared by using the cyan toner 12 produced, and was evaluated for various items in the same manner as in Example 1. As shown in Table 4, the cleaning, sleeve contamination, blocking, charge variation, and fogging of this example were poor.

Comparative Example 4

A cyan toner 13 was produced in substantially the same manner as in Example 9 except that a styrene-acrylic resin was used and the production conditions were altered. A two-component cyan developer 13 was prepared by using the cyan toner 13 produced, and was evaluated for various items in the same manner as in Example 1. As shown in Table 4, the charge variation and fogging of this example were poor.

Comparative Example 5

A cyan toner 14 was produced in substantially the same manner as in Example 9 except that the wax F was used and the production conditions were altered. A two-component cyan developer 14 was prepared by using the cyan toner 14 produced, and was evaluated for various items in the same manner as in Example 1. As shown in Table 4, the fixable range of this example was extremely narrow.

Comparative Example 6

A cyan toner 15 was produced in substantially the same manner as in Example 9 except that the wax G was used. A two-component cyan developer 15 was prepared by using the cyan toner 15 produced, and was evaluated for various items in the same manner as in Example 1. As shown in Table 4, the sleeve contamination, blocking, charge variation, and fogging of this example were poor.

Comparative Example 7

A cyan toner 16 was produced in substantially the same manner as in Example 9 except that the classifier (Elbow-Jet classifier) that did not perform sphering was used instead of the apparatus A. A two-component cyan developer 16 was prepared by using the cyan toner 16 produced, and was evaluated for various items in the same manner as in Example 1. As shown in Table 4, the transfer efficiency decreased.

Example 12

YMC color evaluation was performed by using the two-component cyan developer 1, the two-component yellow developer 1, and the two-component magenta developer 1. The respective developing units in Examples 1, 10, and 11 were similarly satisfactory in terms of transfer efficiency, cleaning, sleeve contamination, blocking, and charge variation. Furthermore, in a fixable range test, a satisfactory result was obtained similarly to Example 1 in an image area on which the cyan toner 1 and the yellow toner 1 were mounted at about fifty-fifty. In addition, in a test in which a combination of the cyan toner 1 and the magenta toner 1 was used, a test in which a combination of the yellow toner 1 and the magenta toner 1 was used, and a test in which the cyan toner 1, the yellow toner 1, and the magenta toner 1 were used in nearly a 1:1:1 ratio, the results were satisfactory similarly to Example 1. As for an image, when the cyan toner 1, the yellow toner 1, and the magenta toner 1 were used, scattering was evaluated as B and fogging was about 1.2.

Example 13

YMC-color-one-component development evaluation was performed by using the cyan toner 1, the yellow toner 1, and the magenta toner 1. The device used was a remodeled device of LBP-2040 (manufactured by Canon) obtained by installing a cleaner unit on LBP-2040. The transfer efficiency, cleaning, sleeve contamination, and blocking resistance of each developing unit were all evaluated as A, that is, they were satisfactory, and the charge variation was evaluated as B, that is, it was satisfactory. Furthermore, in a fixable range test, a satisfactory result was obtained in any of the combinations similarly to Example 12. As for an image, when the cyan toner 1, the yellow toner 1, and the magenta toner 1 were used, scattering was evaluated as B and fogging was about 1.8.

As apparent from the results of the respective examples, a color toner which is effective in mitigating contamination of a charging member, which is good at low temperature fixing in high-speed copying, and which is excellent in blocking resistance and electrification stability in continuous copying can be obtained by controlling a releasing-agent existing amount on the color toner particle surface and conditions contributing to the color toner shape.

What is claimed is:

1. A color toner comprising at least a binder resin, a colorant, and a releasing agent, wherein:

(i) the binder resin contains at least a polyester unit;

(ii) a weight average particle diameter of the color toner is greater than 6.5 μm and equal to or less than 11 μm;

(iii) an average circularity A of particles in the color toner each having a circle-equivalent diameter of 3 μm or more satisfies a relationship of $0.915 \leqq A \leqq 0.960$;

(iv) a permeability B (%) of the color toner in a 45 vol % aqueous solution of methanol satisfies a relationship of $10 \leqq B \leqq 70$; and (v) an endothermic curve obtained through differential thermal analysis (DSC) measurement of the color toner has one or multiple endothermic peaks in a temperature range of 30 to 200° C., and a temperature Tsc of a highest endothermic peak of the one or multiple endothermic peaks satisfies a relationship of 65° C.<Tsc<105° C., wherein the permeability (%) of light at a wavelength of 600 nm in the dispersion is measured spectrophotometrically based on the following equation:

$$\text{Permeability } B\ (\%) = I/I_0 \times 100$$

where $I_0$ denotes incident luminous flux, and I denotes transmitted luminous flux.

2. A color toner according to claim 1, wherein a weight average particle diameter X (μm) and a cumulative value Y (%) of particles each having a circularity of 0.960 or more on a number basis satisfy the following relationship:

$$-X+20 \leqq Y \leqq -X+70.$$

3. A color toner according to claim 2, wherein the weight average particle diameter X and the cumulative value Y of particles each having a circularity of 0.960 or more on a number basis satisfy the following relationship:

$$-X+20 \leqq Y \leqq -X+50.$$

4. A color toner according to claim 1, wherein the binder resin is selected from the group consisting of the following items (a) to (f):

(a) a polyester resin;

(b) a hybrid resin containing a polyester unit and a vinyl-based polymer unit;

(c) a mixture of the hybrid resin and a vinyl-based polymer;

(d) a mixture of a polyester resin and a vinyl-based polymer;

(e) a mixture of the hybrid resin and a polyester resin; and (f) a mixture of a polyester resin the hybrid resin, and a vinyl-based polymer.

5. A color toner according to claim 1, wherein the binder resin contains a hybrid resin containing a polyester unit and a vinyl-based polymer unit.

6. A color toner according to claim 1, wherein the releasing agent is a hydrocarbon-based wax.

7. A color toner according to claim 1, further comprising an aromatic carboxylic acid metal compound.

8. A color toner according to claim 1, wherein the average circularity A of particles in the color toner each having a circle-equivalent diameter of 3 μm or more satisfies a relationship of $0.920 \leqq A \leqq 0.945$.

9. A color toner according to claim 1, wherein the permeability B of the color toner in the 45 vol % aqueous solution of methanol satisfies a relationship of $15 \leqq B \leqq 50$.

10. A color toner according to claim 1, wherein the temperature Tsc of the highest endothermic peak of the one or multiple endothermic peaks satisfies a relationship of $70° C. < Tsc < 90° C.$

11. A color toner according to claim 1, wherein the color toner is one of a yellow toner, a magenta toner, and a cyan toner.

12. A color toner according to claim 1, wherein the color toner is mixed with a carrier to be used as a two-component developer.

13. A color toner according to claim 1 which is subjected to surface treatment by using a batch-type surface treatment apparatus, wherein:

the batch-type surface treatment apparatus comprises:

a classifying means that continuously discharges and removes fine powders each having a particle size equal to or less than a predetermined particle size to an outside of the batch-type surface treatment apparatus;

a surface treatment means that treats surfaces of toner particles by means of mechanical impact force; and a guide means that divides a space between the classifying means and the surface treatment means into a first space and a second space; and the color toner is a toner which is subjected to surface treatment through repeated classification and surface modification treatment by means of mechanical impact force for a predetermined time period, the repeated classification and surface modification treatment by means of mechanical impact force for a predetermined period of time being performed by: introducing particles to be treated into the first space to be classified by the classifying means; introducing the classified particles into the surface treatment means via the second space to be subjected to surface treatment; and circulating the particles having their surfaces treated to the first space again.

* * * * *

UNITED STATES PATENT AND TRADEMARK OFFICE

CERTIFICATE OF CORRECTION

PATENT NO. : 7,112,395 B2
APPLICATION NO. : 10/792712
DATED : September 26, 2006
INVENTOR(S) : Tetsuya Ida et al.

It is certified that error appears in the above-identified patent and that said Letters Patent is hereby corrected as shown below:

COLUMN 32

Lines 31-33 should be deleted;
Line 31, should read --(iv) a permeability B(%) of light at a wavelength of 600 nm in a dispersion of 20 mg of the color toner dispersed in 10 ml of 45 vol % aqueous solution of methanol satisfies a relationship of $10 \leqq B \leqq 70$, wherein the permeability in percentage is measured as I/Io x 100, where Io is incident luminous flux and I is transmitted luminous flux; and--;
Line 40, "wherein the permeability (%) of light" should be deleted; and
Lines 41-47 should be deleted.

COLUMN 33

Line 4, "resin" should read --resin,--.

Signed and Sealed this

Eighteenth Day of December, 2007

JON W. DUDAS
*Director of the United States Patent and Trademark Office*